US006192550B1

(12) United States Patent
Hamada et al.

(10) Patent No.: US 6,192,550 B1
(45) Date of Patent: Feb. 27, 2001

(54) DUST-COLLECTING DEVICE FOR VACUUM CLEANER AND UPRIGHT TYPE VACUUM CLEANER

(75) Inventors: Atsuo Hamada, Kasai; Kazumasa Kamatani, Hyogo-ken; Kazuyoshi Yoshimi, Hyogo-ken; Atsushi Okuda, Hyogo-ken; Souji Sakata, Kasai; Naoki Suetsugu, Kasai; Syuzou Ueyama, Kasai; Nobuaki Takahashi, Kasai, all of (JP)

(73) Assignee: Sanyo Electric Co., Ltd., Osaka-Fu (JP)

( * ) Notice: Subject to any disclaimer, the term of this patent is extended or adjusted under 35 U.S.C. 154(b) by 0 days.

(21) Appl. No.: 09/493,068

(22) Filed: Jan. 28, 2000

(30) Foreign Application Priority Data

Jan. 29, 1999 (JP) ..... 11-022653
Mar. 29, 1999 (JP) ..... 11-085497
Nov. 29, 1999 (JP) ..... 11-337516

(51) Int. Cl.[7] ..... A47L 9/10
(52) U.S. Cl. ..... 15/352; 55/299; 55/305
(58) Field of Search ..... 15/352; 55/295, 55/299, 300, 305

(56) References Cited

U.S. PATENT DOCUMENTS 2,594,456 * 4/1952 Kroenlein ..... 15/352 X
3,591,888 * 7/1971 Takeda et al. ..... 55/300 X
3,653,189 * 4/1972 Miyake et al. ..... 55/300 X
3,841,067 * 10/1974 Kato et al. ..... 15/352 X
5,562,758 * 10/1996 Awaji ..... 55/300 X

* cited by examiner

*Primary Examiner*—Chris K. Moore
(74) *Attorney, Agent, or Firm*—Sughrue, Mion, Zinn, Macpeak & Seas, PLLC

(57) ABSTRACT

A dust-collecting device for a vacuum cleaner comprising a dust-collecting case which is fitted into a suction path extending from a suction nozzle to a motor fan and from which accumulated dust can be discharged by opening a bottom lid of the dust-collecting case, and a cylindrical filter fitted into the dust-collecting case. The filter is arranged to be rotatable, a spiral rib is formed at an outer periphery of the filter, and the device is equipped with a rotating means for rotating the filter. Dust which cannot be discharge by its own weight since it is in a compressed state can be pushed out through the spiral rib formed on the outer periphery of the filter by rotating the filter, so that dust accumulated within the dust-collecting case in a compressed state can be easily discharged.

9 Claims, 35 Drawing Sheets

DUST-COLLECTING DEVICE FOR VACUUM CLEANER AND UPRIGHT TYPE VACUUM CLEANER

BACKGROUND OF THE INVENTION

The present invention relates to a dust-collecting device for a vacuum cleaner used in an upright type vacuum cleaner and to an upright type vacuum cleaner employing the same.

There are conventionally known vacuum cleaners, especially upright type vacuum cleaners which do not employ disposable dust-collecting paper packages but are provided with a dust-collecting device comprising a cylindrical filter within a dust-collecting case which is fitted to a suction path of a main body of the vacuum cleaner in a freely attachable and detachable manner to accumulate dust which has been filtered through the filter within the dust-collecting case wherein the accumulated dust can be discharged by opening a bottom lid. Such a dust-collecting device is economical than compared to disposable paper packages since it can be semi-permanently used by performing maintenance of the filter.

However, it is the case with such a conventional dust-collecting device for a vacuum cleaner that an increase in the amount of dust accumulated within the dust-collecting case results in compression of dust which is adhered to an inner wall of the dust-collecting case, so that dust cannot be discharged by its own weight through the discharge outlet by simply opening the bottom lid of the dust-collecting case. Thus, dust need to be scraped out by hand so that this procedure is quite annoying and also unhygienic.

Further, since dust (minute dust) which is adhering to the filter needs to be removed regularly by detaching the filter, this removal of adhering dust might be troublesome and in case such removing processes are neglected, plugging owing to dust adhering to the filter might occur so that dust-collecting efficiency is degraded.

It should be noted that a known type of dust-collecting device employing no paper package or filter which is apt to be plugged is a dust-collecting device of cyclone separating type wherein dust is simply accumulated in the dust-collecting case after separation in such a dust-collecting device of cyclone separating type to thereby present a poor dust compression rate so that the dust-collecting case is filled up with dust shortly.

The present invention has thus been made with the aim to solve such problems, and it is an object thereof to enable easy discharge of dust which has been compressed and accumulated in a dust-collecting case.

It is another object thereof to enable easy removal of dust which has adhered to a filter to thereby prevent degradation of dust-collecting efficiency owing to plugging.

It is still another object thereof to improve a compression rate of dust accumulated in the dust-collecting case and to achieve improvements in collecting amount with respect to dust-collecting capacity.

SUMMARY OF THE INVENTION

For achieving the above objects, the device of the present invention comprises a dust-collecting case which is fitted into a suction path extending from a suction nozzle to a motor fan in a freely attachable and detachable manner and from which accumulated dust can be discharged by opening a bottom lid of the dust-collecting case, and a cylindrical filter fitted into the dust-collecting case for filtering dust contained in air which is taken in into the dust-collecting case, wherein the filter is arranged to be rotatable, a spiral rib is formed at an outer periphery of the filter, and the device is equipped with a rotating means for rotating the filter.

Further, the device of the present invention comprises a dust-collecting case which is fitted into a suction path extending from a suction nozzle to a motor fan in a freely attachable and detachable manner and from which accumulated dust can be discharged by opening a bottom lid of the dust-collecting case, a cylindrical pre-filter fitted into the dust-collecting case for filtering coarse dust contained in air which is taken in into the dust-collecting case, and a cylindrical main filter fitted into the pre-filter for filtering minute dust contained in air which has been filtered by the pre-filter for eliminating coarse dust, wherein the pre-filter is arranged to be rotatable, a spiral rib is formed at an outer periphery of the pre-filter, and the device is equipped with a rotating means for rotating the pre-filter.

The pre-filter is characterized in that its filter portion is designed to be located in a lower portion in the dust-collecting case.

The pre-filter is characterized in that it is further provided with elastic protrusions which hit against the main filter through rotation thereof to make the main filter oscillate.

The rotating means is characterized in that it includes of a handle and a gear mechanism for connecting a rotating axis of the handle and an attaching plate for the pre-filter.

Alternatively, the rotating means is characterized in that it includes a slide lever and a gear mechanism which is connected to the slide lever in case the slide lever is slid in either direction for rotating the pre-filter in a specified direction.

The dust-collecting case is characterized in that it is provided with a grip, wherein a fulcrum for opening and closing the bottom lid is provided on a same side as that of the grip.

The dust-collecting case is characterized in that it is provided with a grip, wherein a fulcrum for opening and closing the bottom lid is provided on an opposing side as that of the grip.

Moreover, the present invention relates to an upright type vacuum cleaner with the above-described dust-collecting device for a vacuum cleaner being fitted to a main body of the upright type vacuum cleaner in a freely attachable and detachable manner, wherein the vacuum cleaner comprises a handle for operating the main body extending upward from a front surface side of the main body of the vacuum cleaner, the dust-collecting device is fitted to the front surface side of the main body of the vacuum cleaner in a freely attachable and detachable manner, and a grip of the dust-collecting device is formed to extend downward from the handle in a successive manner for operating the main body.

DETAILED DESCRIPTION

Figure 1:
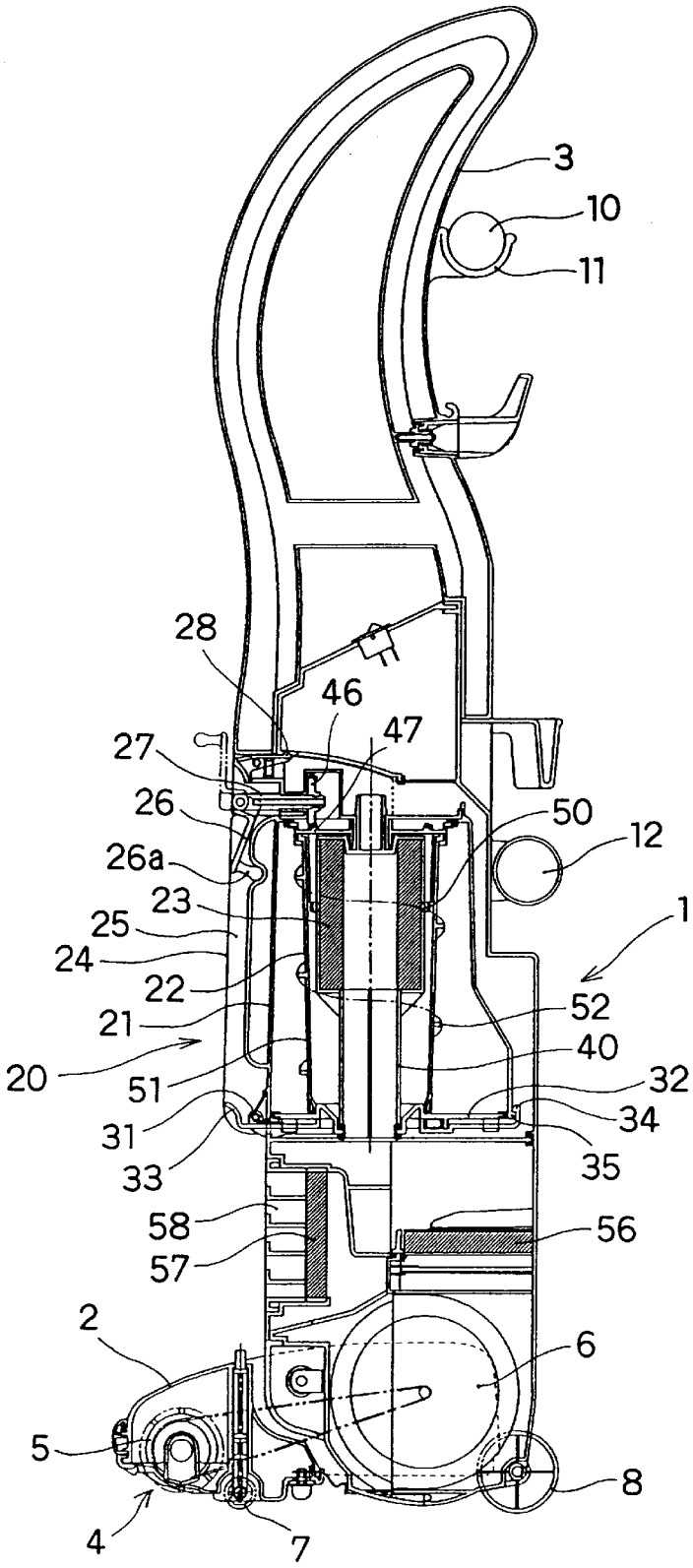
FIG. 1 is a longitudinal sectional view seen from a lateral surface side of an upright type vacuum cleaner utilizing a dust-collecting device according to one embodiment of the present invention.
Figure 2:
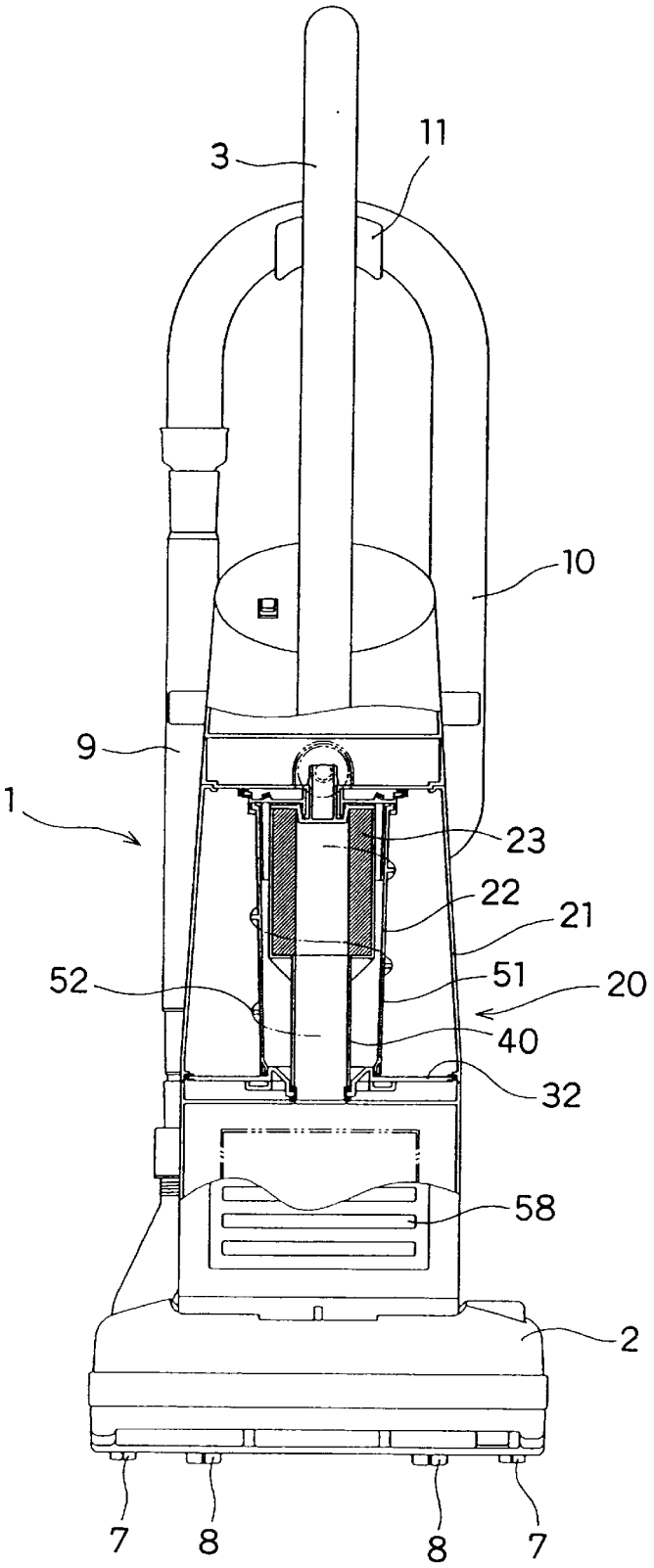
FIG. 2 is a longitudinal sectional view seen from a front surface side showing main portions of the upright type vacuum cleaner utilizing the dust-collecting device according to one embodiment of the present invention.

One embodiment of the present invention will now be explained in details with reference to FIGS. 1 to 9.

In this embodiment, the present invention has been applied to a dust-collecting device for a vacuum cleaner of upright type (vertical type) wherein the upright type vacuum cleaner is so arranged that a suction nozzle 2 for floors is formed at a lower portion of a main body 1 of the vertical type vacuum cleaner and a handle 3 for operating the main body at an upper portion thereof, all of which are formed in an uniform manner. As illustrated in FIGS. 1 to 5, this handle 3 for operating the main body extends upward from a front surface side of the main body 1 of the vacuum cleaner and is folded at an upper end portion to be connected at an upper portion on a rear surface side of the main body 1 of the vacuum cleaner.

The suction nozzle 2 for floors has a suction inlet 4 at a bottom surface side and further incorporates therein a rotating brush 5 to face the suction inlet 4. The rotating brush 5 is connected to a rotating shaft of a motor fan 6 which is incorporated in the lower portion of the main body 1 of the vacuum cleaner to be driven thereby in a rotating manner. A pair of laterally arranged front wheels 7 are attached frontward of the bottom surface of the suction nozzle 2 for floors, while a pair of laterally arranged rear wheels 8 are attached rearward of a lower portion of the main body 1 of the vacuum cleaner.

To a rear surface on either side of the suction nozzle 2 for floors, there is attached a pipe 9 which communicates to the suction inlet 4 on the bottom surface side wherein this pipe 9 is extended upward along the main body 1 of the vacuum cleaner to which a tip end portion of a hose 10 is connected in a freely attachable and detachable manner. This hose 10 is forwarded to the rear surface side of the main body 1 of the vacuum cleaner by means of a holding portion 11 arranged on a rear surface side of the handle 3 for operating the main body and is connected to a suction cylinder 12 which is formed to be shifted to either side with respect to a center of the rear surface side.

On the other hand, a dust-collecting device (dust-collecting unit) 20 of the present invention is fitted to a central portion on the front surface side of the main body 1 of the vacuum cleaner in a freely attachable and detachable manner.

The dust-collecting device 20 is so arranged, as illustrated in FIGS. 6 to 9, that a cylindrical pre-filter 22 made of transparent resin or the like is fitted into an interior of a substantially cylindrical dust-collecting case 21 made of transparent resin or the like, while the pre-filter further accumulates therein a substantially cylindrical main filter 23.

Figure 3:
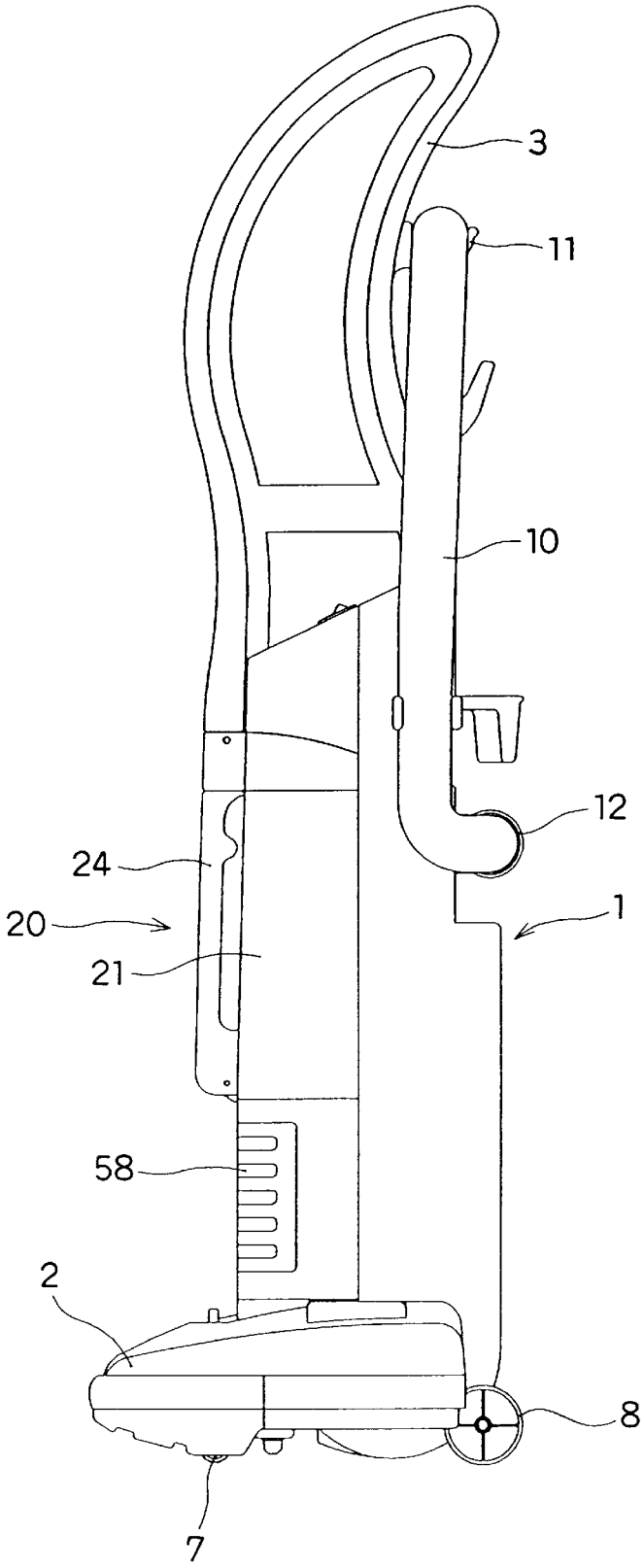
FIG. 3 is a side view of the upright type vacuum cleaner utilizing the dust-collecting device according to one embodiment of the present invention.
Figure 4:
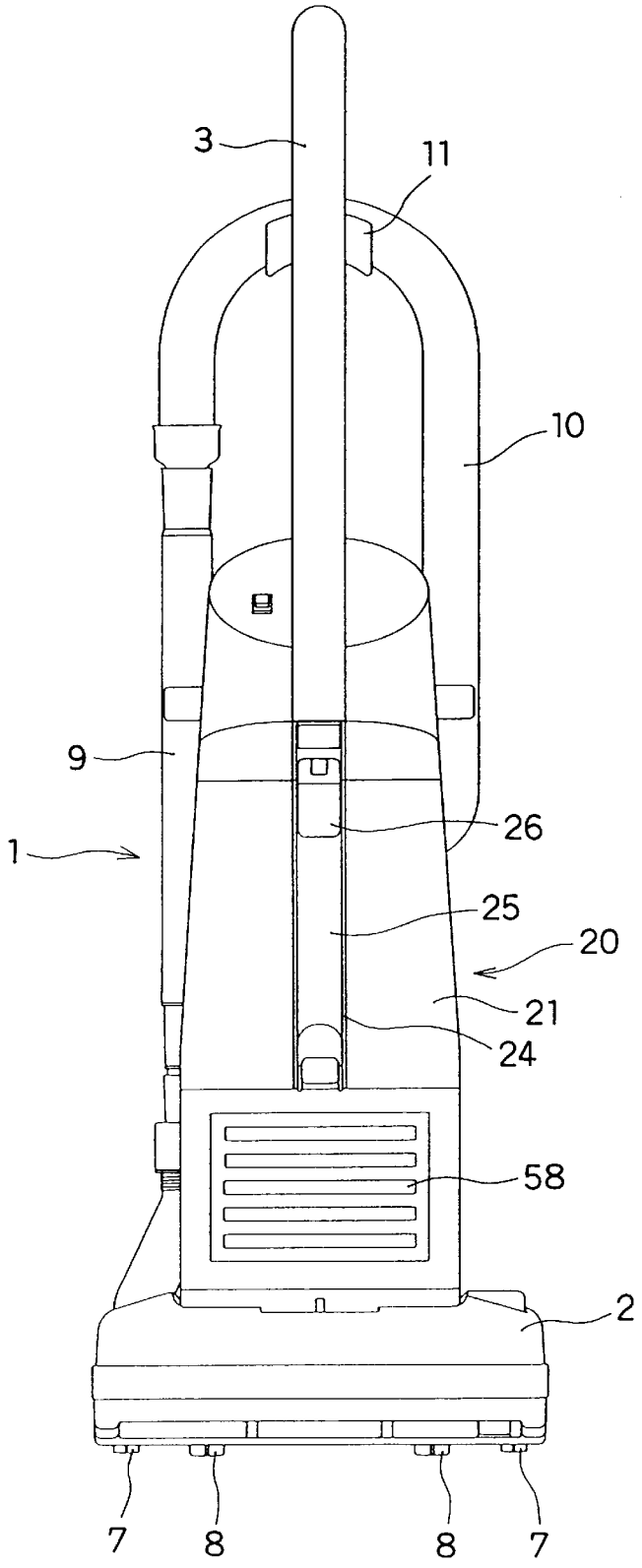
FIG. 4 is a front view of the upright type vacuum cleaner utilizing the dust-collecting device according to one embodiment of the present invention.
Figure 5:
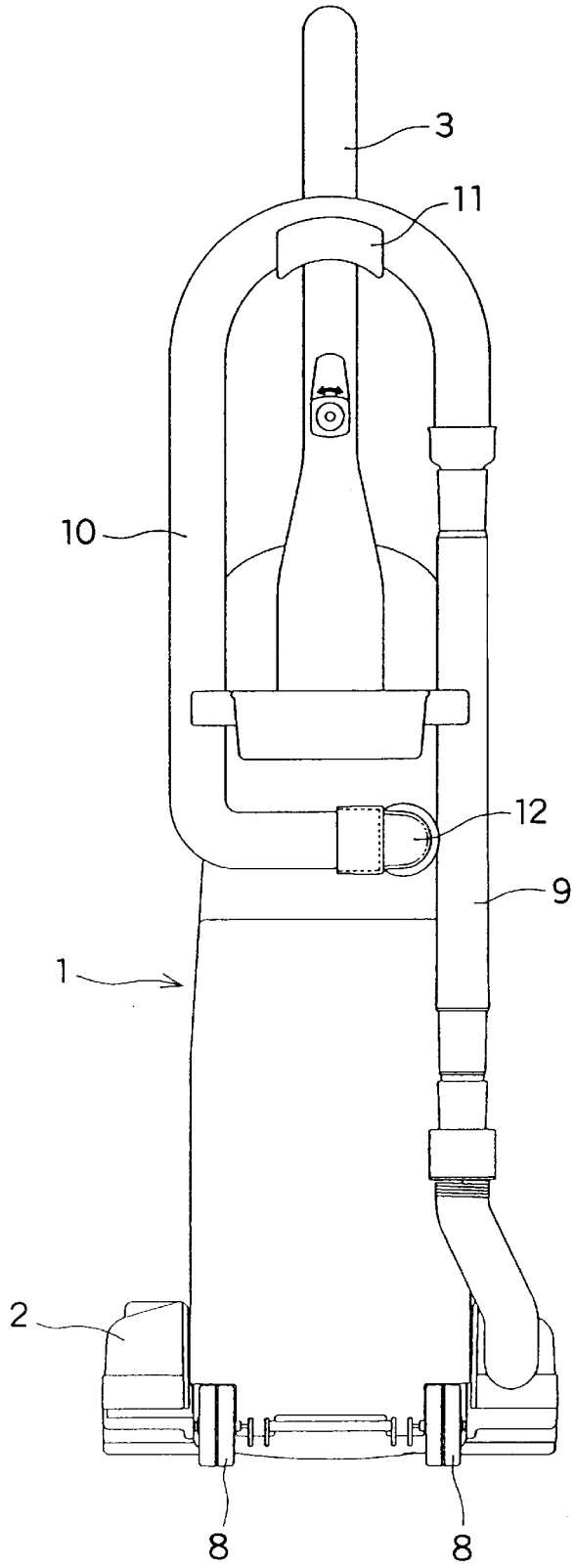
FIG. 5 is a rear view of the upright type vacuum cleaner utilizing the dust-collecting device according to one embodiment of the present invention.

The dust-collecting case 21 is provided with a grip 24 at a central portion on a side which faces to the front when being attached to the main body 1 of the vacuum cleaner. The grip is so arranged as to extend in a longitudinal direction in a successive manner downward to the handle 3 for operating the main body as seen in FIGS. 3 and 4, wherein a groove 25 is formed on a surface of the grip 24.

Figure 7:
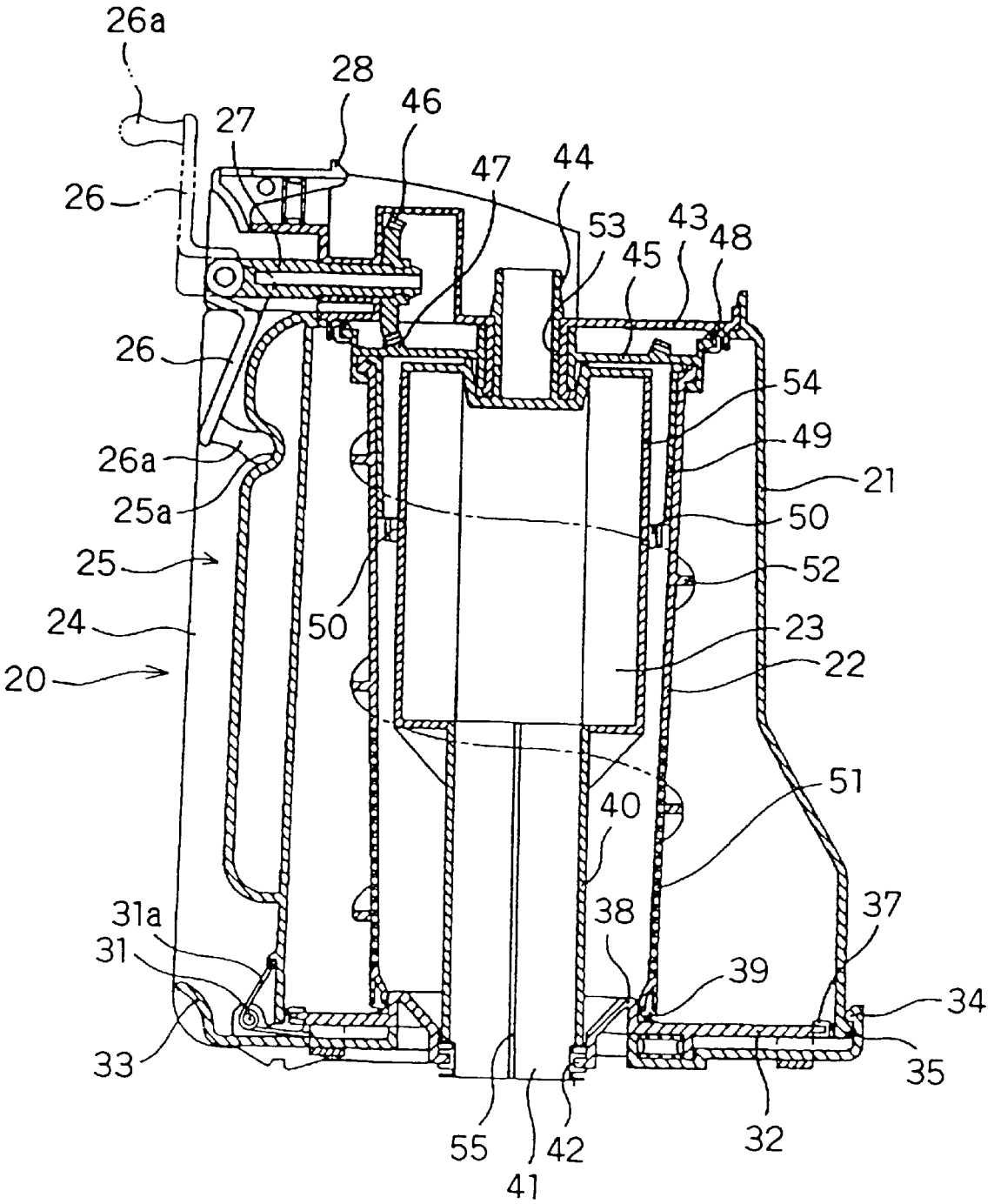
FIG. 7 is a longitudinal sectional view of the dust-collecting device according to one embodiment of the present invention.
Figure 8:
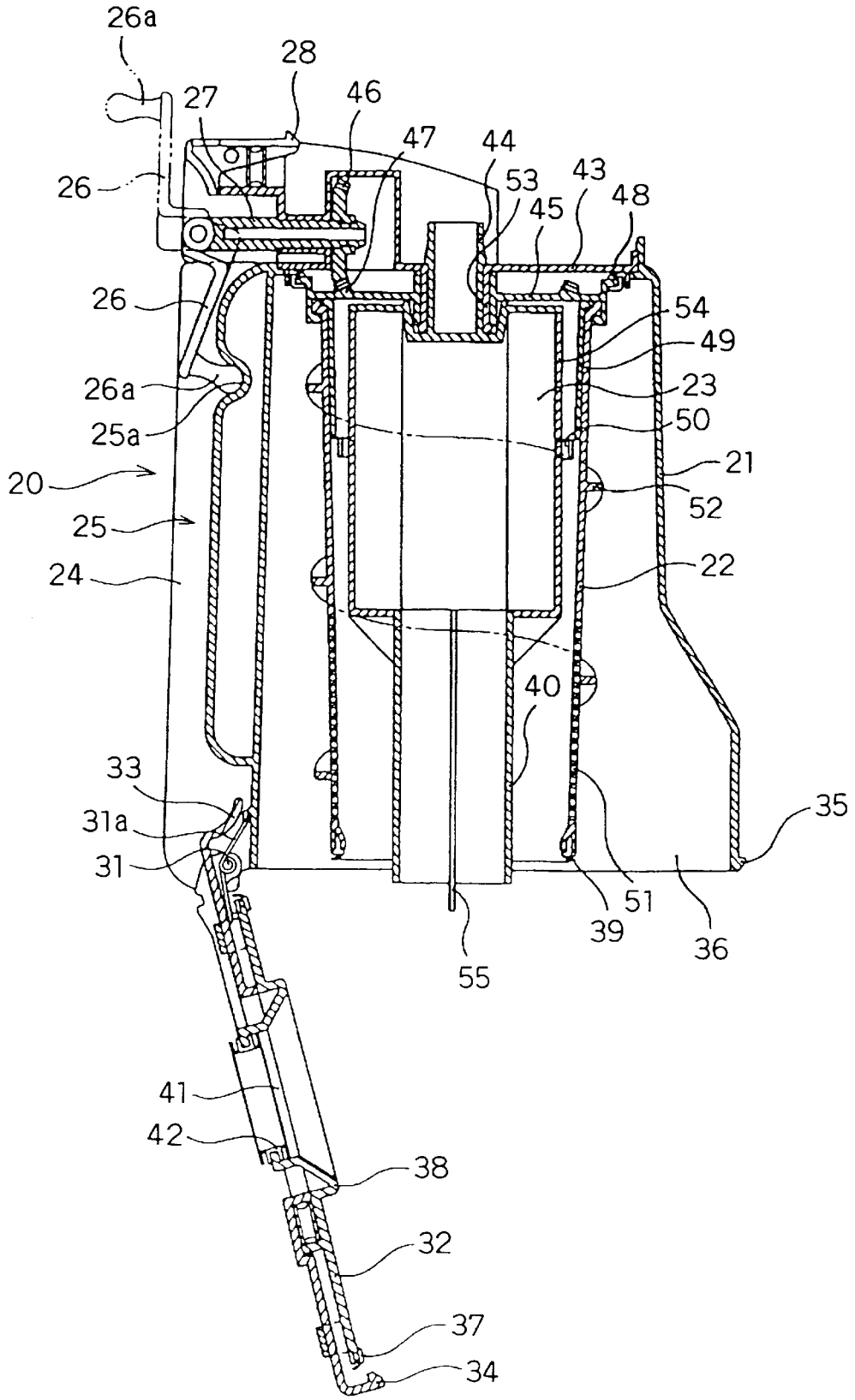
FIG. 8 is a longitudinal sectional view of the dust-collecting device according to one embodiment of the present invention with a bottom lid thereof being in an opened condition.
Figure 9:
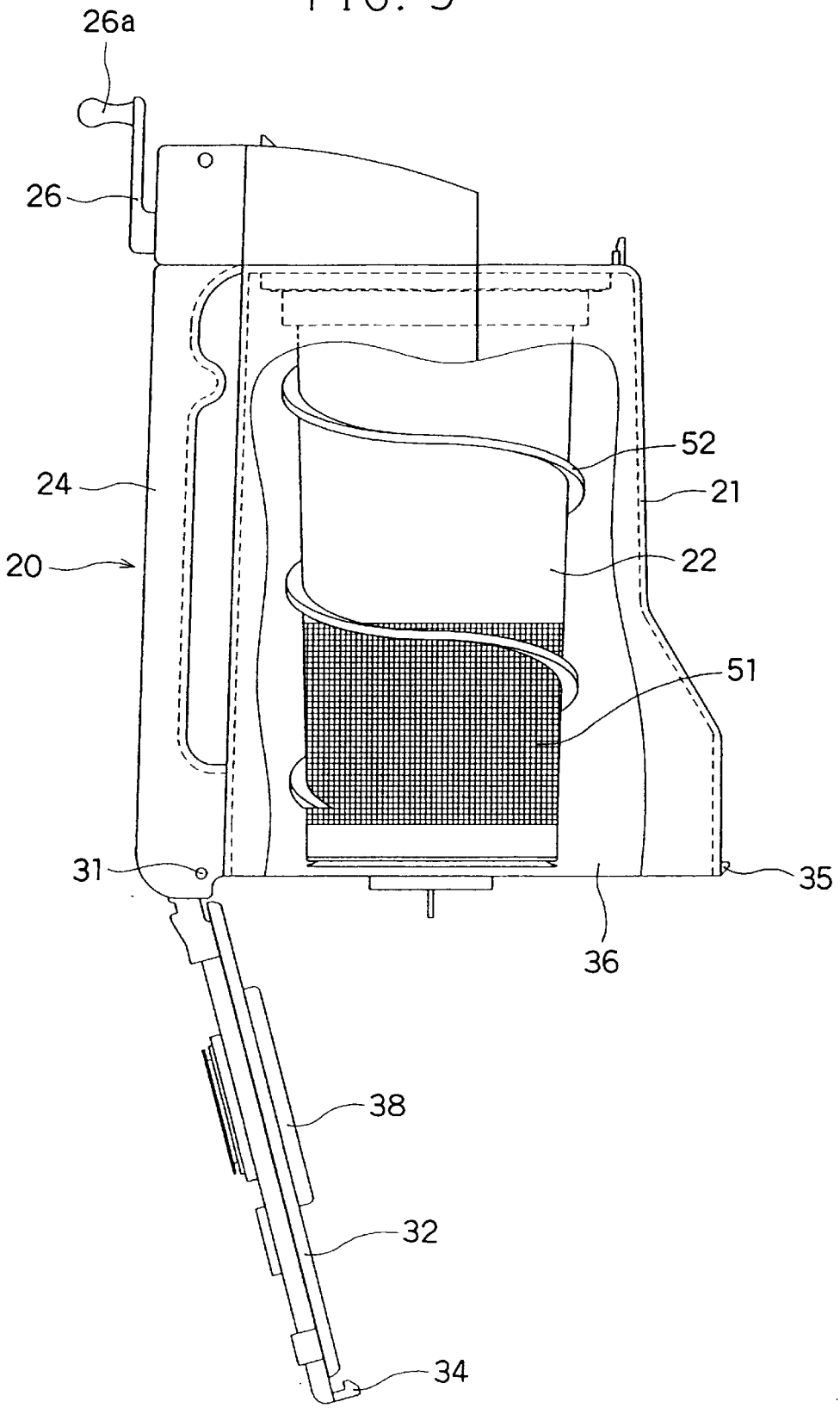
FIG. 9 is a partially cut-away side view of the dust-collecting device according to one embodiment of the present invention with the bottom lid thereof being in an opened condition.

A handle 26 which is rotatable by hand for rotating the pre-filter 22 is attached to an upper side of the grip 24 in such a manner that it is freely foldable in a transverse direction with respect to a rotating axis 27 thereof. That is, as illustrated in FIG. 7 and other drawings, by folding the handle 26 from a position as represented by the two-dot chain line to a position as represented by the solid line in a rotating manner, the handle 26 can be accumulated in the groove 25 of the grip 24 while a knob 26*a* of the handle 26 is fitted to a concave portion 25*a* formed in the groove 25 of the grip 24 to be fixed thereat. With this arrangement, there can be prevented that the handle 26 is erroneously rotated though it is not necessary or that the handle 26 is damaged by hitting against something. Further, it is possible to easily discharge dust accumulated within the dust-collecting case 21 by holding the grip 24, and the handle 26 can also be accumulated by efficiently utilizing the grip 24 which is not needed at the time of performing cleaning.

A clamp 28 to be engaged with the main body 1 when the dust-collecting device 20 is fitted to the main body 1 of the vacuum cleaner is provided on an upper side of the handle 26 of the dust-collecting device 20.

Figure 6:
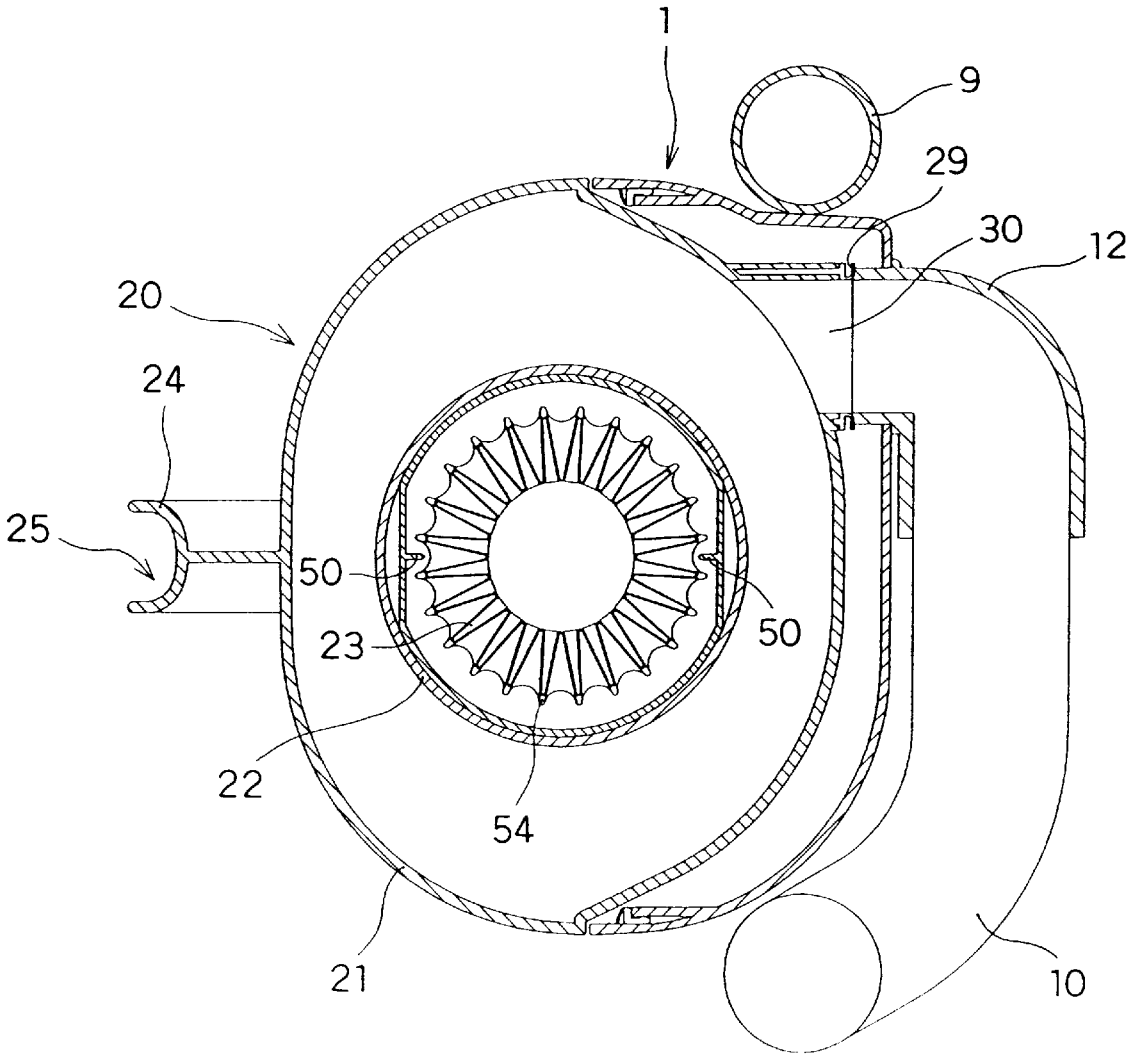
FIG. 6 is a lateral sectional view of the upright type vacuum cleaner utilizing the dust-collecting device according to one embodiment of the present invention.

As shown in FIG. 6, the dust-collecting case 21 is also provided with a suction hole 30 which is sealingly communicated via a packing 29 with an inner aperture of the suction cylinder 12 attached to the rear surface of the main body 1 at a position which is shifted to either side on a surface which corresponds to a back side when being fitted to the main body 1 of the vacuum cleaner. By arranging the suction hole 30 of the dust-collecting case 21 to be shifted to either side with respect to a center thereof, air containing dust therein which is sucked through the suction hole 30 can be revolved within the dust-collecting case 21.

Further, to a bottom portion of the dust-collecting case 20, there is attached a bottom lid 32 which is arranged to be freely openable and closable by a hinge 31 provided in a lower portion of the grip 24. The bottom lid 32 is so arranged that by pushing a lever 33 provided in a lower portion of the grip 24, a clamp 34 formed on an opposing side of the dust-collecting case 21 to be connected to the lever 33 is disengaged from an engaging jaw 35 to thereby release a discharge outlet 36 for the dust as shown, for instance, in FIG. 8.

A torsion spring 31 a is fitted to a hinge 31, to which the bottom lid 32 is attached, for abutting against a connecting rod portion of the lever 33 with the bottom lid 32 being in a closed condition as shown in FIG. 7 and for energizing the bottom lid 32 in a releasing direction. A packing 37 for providing close contact with an aperture edge of the dust-collecting case 21 is fitted to an outer peripheral edge of the bottom lid 32.

An annular convex portion 38 for fitting against an inner periphery of a lower aperture of the pre-filter 22 is formed on an upper surface of the bottom lid 32 so as to prevent lateral shift of the lower end portion of the pre-filter 22 owing to rotation. A packing 39 is attached to an aperture end of the pre-filter 22 for providing close contact with the upper surface of the bottom lid 32.

A suction hole 41 to which an aperture side of a lower portion of a cylindrical body 40 forming an air flow passage from the main filter 23 for communicating to an exterior of the dust-collecting case 21 is formed inside of the annular convex portion 38 of the bottom lid 32, wherein a packing 42 is attached to an inner peripheral edge of the suction hole 41 for closely contact with an aperture end of the cylindrical body 40 of the main filter 23.

The main filter 23 is attached to a top plate 43 of the dust-collecting case 21 via an attaching shaft 44 which is formed on an upper surface thereof. Between the top plate 43 of the dust collection case 21 and the upper surface of the main filter 23, there is attached an attaching plate 45 of the pre-filter 22 which utilizes the attaching shaft 44 of the main filter 23 as its rotating axis.

On an upper surface of the attaching plate 45 of the pre-filter 22, there is formed an annular bevel gear 47 to be engaged with a disk-like bevel gear 46 attached to the rotating axis 27 of the handle 26 for rotating the filter such that the pre-filter 22 might be rotated corresponding to a rotational direction of the handle 26 for rotating the filter. With this arrangement, the pre-filter 22 can be reliably rotated with a relatively simple arrangement. A packing 48 for providing close contact with the top plate 43 of the dust-collecting case 21 is fitted to an outer peripheral edge of the attaching plate 45 so as to prevent dust from entering the above gear mechanism or the rotating axis.

A cylindrical body 49 made of elastic resin or the like is disposed in an upper portion of the inner periphery of the pre-filter 22, and elastic protrusions 50, which abut against a pleat-like tip end portion of the main filter 23 as will be described later are formed at positions opposing a lower portion side of the cylindrical body 49 as to protrude inwardly. With this arrangement, a front surface side of the main filter to which dust adheres can be repelled such that adhering dust can be more efficiently removed.

The pre-filter 22 is further so arranged that its lower portion side is formed as a mesh 51 so that relatively large-sized dust (coarse dust) can be filtered by this mesh 51. By forming the mesh 51 which composes a filter portion of the pre-filter 22 to be located in a lower portion in the dust-collecting case 21, dust which has entered together with air through the suction hole 30 located in an upper portion in dust-collecting case 21 is pushed downward while being revolved at high speed, so that it can be deposited on the bottom surface of the dust-collecting case 21 (bottom lid 32) in a pressed condition.

A spiral rib 52 is formed as to extend in vertical directions on an outer periphery of the pre-filter 22. The spiral rib 52 is so formed that dust which has been accumulated and compressed within the dust-collecting case 21 is pushed out in a direction of the discharge outlet 36 when the bottom lid 32 is opened in case the above-described handle 26 for rotating the filter is rotated in a rightward direction.

On the other hand, the main filter 23 is a cylindrically arranged filtering paper which is folded in a pleat-like (bellow-like) manner and is disposed above the cylindrical body 40 forming an airflow passage of filtered air, wherein an attaching shaft 44 formed on its upper portion is fitted to an attaching hole 53 formed on the top plate 43 of the dust-collecting case 21 and wherein it is fixed so as not to rotate in accordance with rotating movements of the pre-filter 22.

The pleat-like tip end portion of the main filter 23 is covered with resin 54 for preventing wear owing to contact with the elastic protrusions 50 formed on the inner peripheral side of the pre-filter 22.

A detaching plate 55 is attached within the cylindrical body 40 of the main filter 23 which is exposed through the aperture on the lower portion side. Since clean air after being filtered of minute dust passes through the cylindrical body 40, it is most hardly soiled and by performing operations for detaching the main filter 23 or other members by gripping this detaching plate 55, one can perform operations without staining one's hands.

It should be noted that air which has been filtered of dust within the dust-collecting device 20 exits through the aperture on the lower portion side of the cylindrical body 40 of the main filter 23 to the exterior of the dust-collecting case 21, and is taken in by the motor fan 6 via a filter 56 shown in FIG. 1 to be exhausted through an exhaust outlet 58 formed on a lower portion of a front surface of the main body 1 of the vacuum cleaner to the exterior by being passed from the motor fan 6 through an exhaust filter 57.

In the upright type vacuum cleaner of the present embodiment, dust which has been scraped up by the rotating brush 5 of the suction nozzle 2 for floors passes through a pipe 9 and hose 10 into the dust-collecting case 21 through the suction cylinder 12 located to be shifted in either direction with respect to a center of the rear surface side of the main body 1 and is made to flow downward by being revolved along the inner wall thereof while large-sized dust (coarse dust) is deposited on the bottom.

At this time, since the mesh 51 of the pre-filter 22 for sucking air is formed to be located downward within the dust-collecting case 21, dust which has entered together with air through the suction hole 30 located upward within the dust-collecting case 21 is pushed downward by being revolved at a high speed so as to be deposited on the bottom surface (bottom lid 32) of the dust-collecting case 21 in a pressed condition. Such an arrangement is especially effective for flock-like dust, and the compression rate can be improved by several times when compared with cyclone separating type ones as discussed for the prior art. Since the compression rate can be increased in this manner, a large amount of dust can be collected even when the dust-collecting capacity remains the same.

Further, small-sized dust (minute dust) enters into the pre-filter 22 by passing through the mesh 51 arranged in the lower portion of the pre-filter 22 and is filtered by the pleat-like main filter 23, so that only clean air enters the main filter 23 to flow downward through the motor fan 6 to be finally exhausted through the exhaust outlet 58 to the exterior.

As explained above, the cylindrical pre-filter 22 arranged in the dust-collecting device 20 of the present embodiment is provided with elastic protrusions 50, which abut against the pleat-like tip end portion (resin 54) of the main filter 23 at opposing positions on the inner peripheral side of the pre-filter 22. The outer peripheral surface thereof is provided with a spiral rib 52. Further, the pre-filter 22 is fitted to a lower surface of the attaching plate 45 while the attaching plate 45 is communicated to the handle 26 for rotating the filter via the bevel gears 46, 47.

Therefore, by rotating the handle 26 provided on the front surface of the dust-collecting device 20 (the front surface of the main body 1 of the vacuum cleaner) in an arbitrary direction, the pre-filter 22 is rotated in a corresponding direction by means of the bevel gears 46, 47 and the attaching plate 45. When the pre-filter 22 is rotated, the protrusions 50 formed on the inner side thereof repel the pleat-like tip end portion (resin 54) of the main filter 23 so that minute dust adhering on the surface of the main filter 23 is shaken down through this oscillation to drop downward. Since the pre-filter 22 is simultaneously oscillated through reaction, minute dust adhering to the pre-filter 22 can also be removed. Moreover, since large-sized dust (coarse dust) which is disposed within the dust-collecting case 21 in a compressed condition functions to wipe off minute dust adhering on the outer peripheral surface of the pre-filter 22, the dust removing effects can be further improved. Therefore, degradations in dust-collecting efficiency owing to adhesion of dust to the main filter 23 (and the pre-filter 22) can be effectively prevented.

Further, while large-sized dust (coarse dust) deposited within the dust-collecting case 21 gradually blocks the mesh 51 formed in the lower portion of the pre-filter 22, the spiral rib 52 formed on the outer periphery of the pre-filter is moved up and down owing to the above-described rotation of the pre-filter 22 and acts to form a clearance (airflow passage) between the mesh 51 of the pre-filter 22 and the dust. It is possible to prevent degradation of dust-collecting efficiency also through this arrangement.

Next, for discharge of dust which has been accumulated in the dust-collecting case 2 1, by holding the grip 24 of the dust-collecting case 21 and drawing the case out with pushing an operating portion of the clamp 28 disposed above the grip 24 upward, the dust-collecting case 21 is detached from the main body 1 of the vacuum cleaner.

By pushing a lever 33 provided in the lower portion of the dust-collecting case 21, the clamp 34 is detached whereby the bottom lid 32 is released to enable discharge of dust which has been accumulated in the dust-collecting case 21. At this time, especially flock-like dust adheres to the inner wall of the dust-collecting case 21 in a compressed state so that dust does not easily come off as it is. Thus, the handle 26 is rotated in a specified direction (in this case in a rightward direction) for rotating the pre-filter 22 in a specified direction whereby the spiral rib 52 provided on the outer periphery of the pre-filter 22 acts to push out dust such as flock-like dust in a compressed state so that easy discharge is enabled.

In addition thereto, since the fulcrum (hinge 31) for opening and closing the bottom lid 32 is provided on the same side as the grip 24 of the dust-collecting case 21, there can be prevented by the bottom lid 32 that dust to be discharged moves to the user holding the grip 24 in case the bottom lid 32 is opened with holding the grip 24 (see FIGS. 8 and 9), and there can be avoided inconveniences that dust falls on the user.

At the time of performing discharge of dust in the explained manner, the above-described dust removing function is exhibited accompanying the rotation of the pre-filter 22 whereby dust is removed each time discharge of dust is performed without the user being aware of removing dust of the filter, so that degradation of dust-collecting efficiency can be prevented in an unconscious manner.

As explained so far, the device according to the present embodiment can be semi-permanently used without the necessity of using disposable paper packages so as to present advantages that it is economical and that inconveniences of use which were presented in contrast to paper packages are improved, whereby there can be obtained a device of remarkably improved convenience of use.

Such a dust-collecting device 20 is favorably used especially with an upright type vacuum cleaner with which a space for fitting can be sufficiently secured due to its vertical structure and of which dust-collecting capacity is also large.

Further, since the upright type vacuum cleaner according to the present embodiment is so arranged, as shown in FIGS. 1 and 3, that its handle 3 for operating the main body is extending upward from the front surface side of the main body 1 of the vacuum cleaner, in case of performing cleaning, for instance an area located under a bed, by inclining the main body 1 rearward at a large angle, a portion for gripping can be located at a high position by holding the front surface side of the handle 3 for operating the main body. Thus, the user needs not to bend himself or herself down so that the user can perform cleaning at an easy posture.

In addition, the grip 24 of the dust-collecting device 20 and the handle 3 for operating the main body as well as the handle 26 for rotating the filter and the operating portion for performing attaching or detaching of the dust-collecting device are aligned on the same line on the front surface of the main body as shown in FIGS. 3 and 4, the device is designed to assume a neat and harmonized appearance.

It should be noted that while the main filter 23 is formed to assume a substantially cylindrical shape in the above embodiment, it might also assume a cylindrical shape having a hexagonal section or the like.

FIGS. 10 to 17 represent another embodiment of the present invention and reference numerals which are identical to those of FIGS. 1 to 9 related to the above-described embodiment indicate identical or equivalent portions.

In the present embodiment, the present invention is similarly is applied to a dust-collecting device for an upright type vacuum cleaner wherein this upright type vacuum cleaner is so arranged that a suction nozzle 2 for floors is formed on a lower portion of a vertical type main body 1 of the vacuum cleaner and that a handle 3 for operating the main body which is of different design as that of the above-described embodiment is formed on an upper portion thereof, each in an uniform manner. As shown in FIGS. 10 to 13, the handle 3 for operating the main body extends upward from a front surface side of the main body 1 of the vacuum cleaner wherein a grip portion 3*a* is formed at an top end portion thereof.

The suction nozzle 2 for floors has a suction inlet 4 at a bottom surface side and further incorporates therein a rotating brush 5 to face the suction inlet 4. The rotating brush 5 is connected to a rotating shaft of a motor fan 6 which is incorporated in the lower portion of the main body 1 of the vacuum cleaner to be driven thereby in a rotating manner. A pair of laterally arranged front wheels 7, are attached frontward of the bottom surface of the suction nozzle 2 for floors, while a pair of laterally arranged rear wheels 8, are attached rearward of a lower portion of the main body 1 of the vacuum cleaner.

To a rear surface on either side of the suction nozzle for floors 2 (the opposite side of that of the previous embodiment), there is attached a pipe 9 which communicates to the suction inlet 4 on the bottom surface side wherein this pipe 9 is extended upward along the main body 1 of the vacuum cleaner to which a tip end portion of a hose 10 is connected in a freely attachable and detachable manner. This hose 10 is forwarded to the rear surface side of the main body 1 of the vacuum cleaner by means of a holding portion 11 arranged on a rear surface side of the handle 3 for operating the main body and is connected to a suction cylinder 12 which is formed to be shifted to either side (the opposite side of that of the previous embodiment) with respect to a center of the rear surface side.

On the other hand, a dust-collecting device (dust-collecting unit) 20 of the present invention is fitted to a central portion on the front surface side of the main body 1 of the vacuum cleaner in a freely attachable and detachable manner.

The dust-collecting device 20 is so arranged, as illustrated in FIGS. 14 to 17, that a cylindrical pre-filter 22 made of transparent resin or the like is fitted into an interior of a substantially cylindrical dust-collecting case 21 made of transparent resin or the like, while the pre-filter further accumulates therein a substantially hexagonal-sectioned cylindrical main filter 23.

Figure 10:
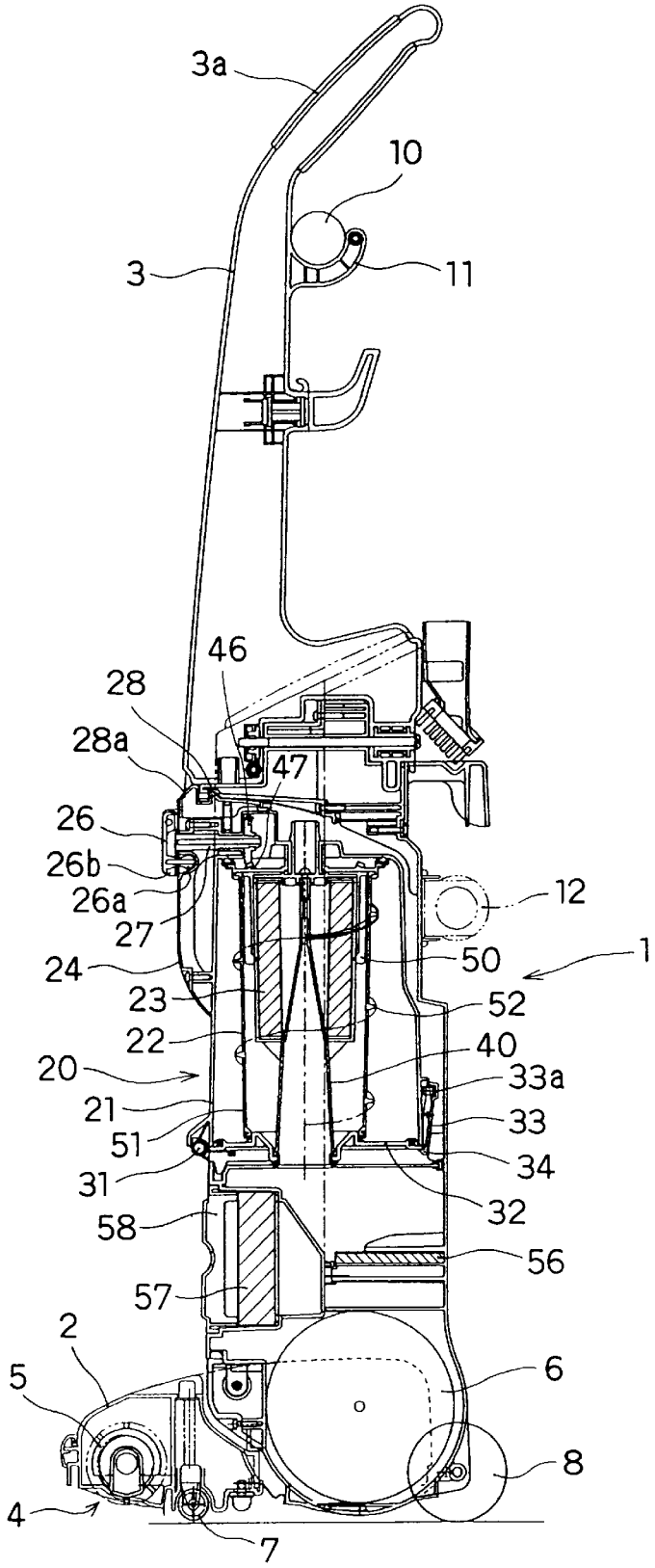
FIG. 10 is a longitudinal view seen from a lateral surface side of an upright type vacuum cleaner utilizing a dust-collecting device according to another embodiment of the present invention.
Figure 12:
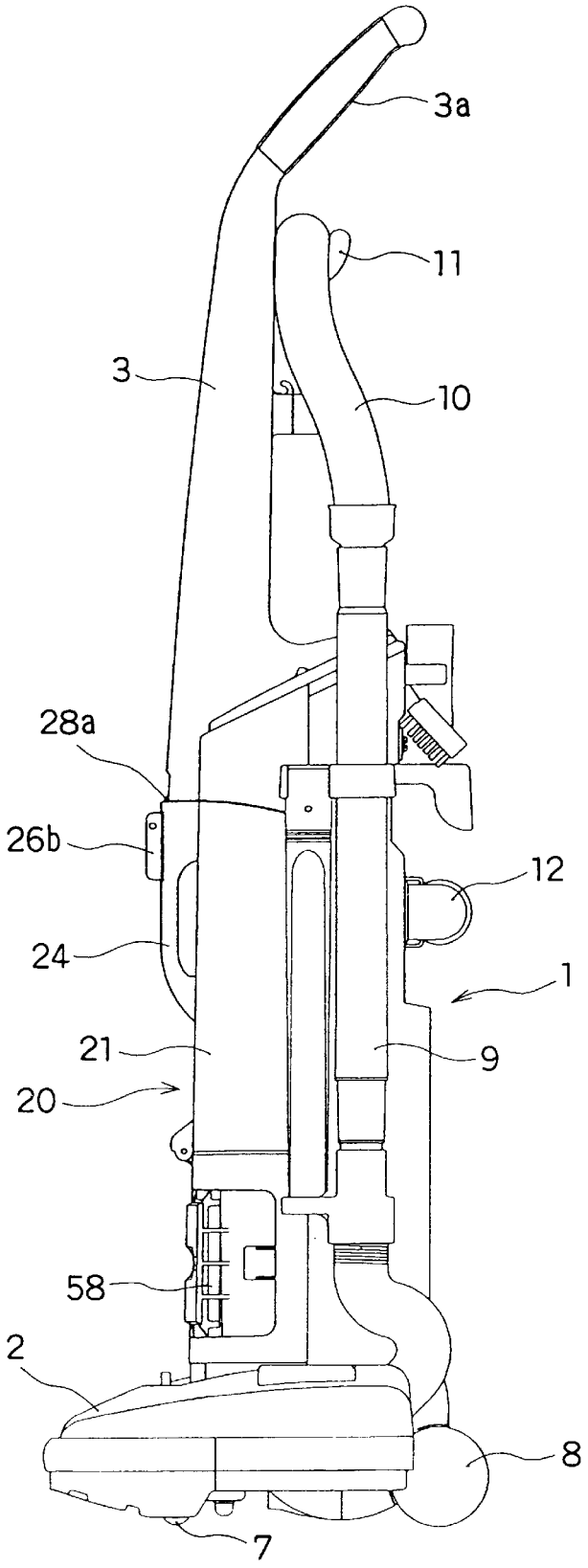
FIG. 12 is a side view of the upright type vacuum cleaner utilizing the dust-collecting device according to another embodiment of the present invention.
Figure 13:
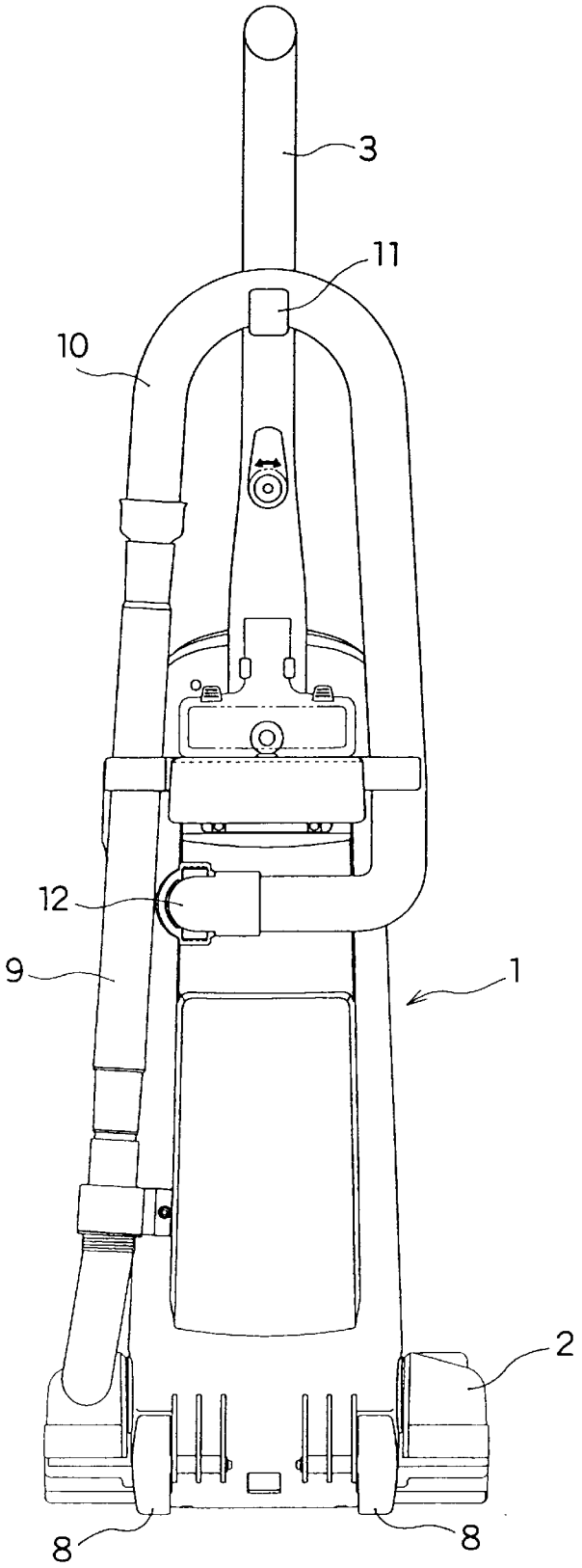
FIG. 13 is a rear view of the upright type vacuum cleaner utilizing the dust-collecting device according to another embodiment of the present invention.

The dust-collecting case 21 is provided with a grip 24 at a central portion on a side which faces to the front when being attached to the main body 1 of the vacuum cleaner. The grip is so arranged as to extend in a longitudinal direction in a successive manner downward to the handle 3 for operating the main body as seen in FIGS. 10 and 12.

Figure 15:
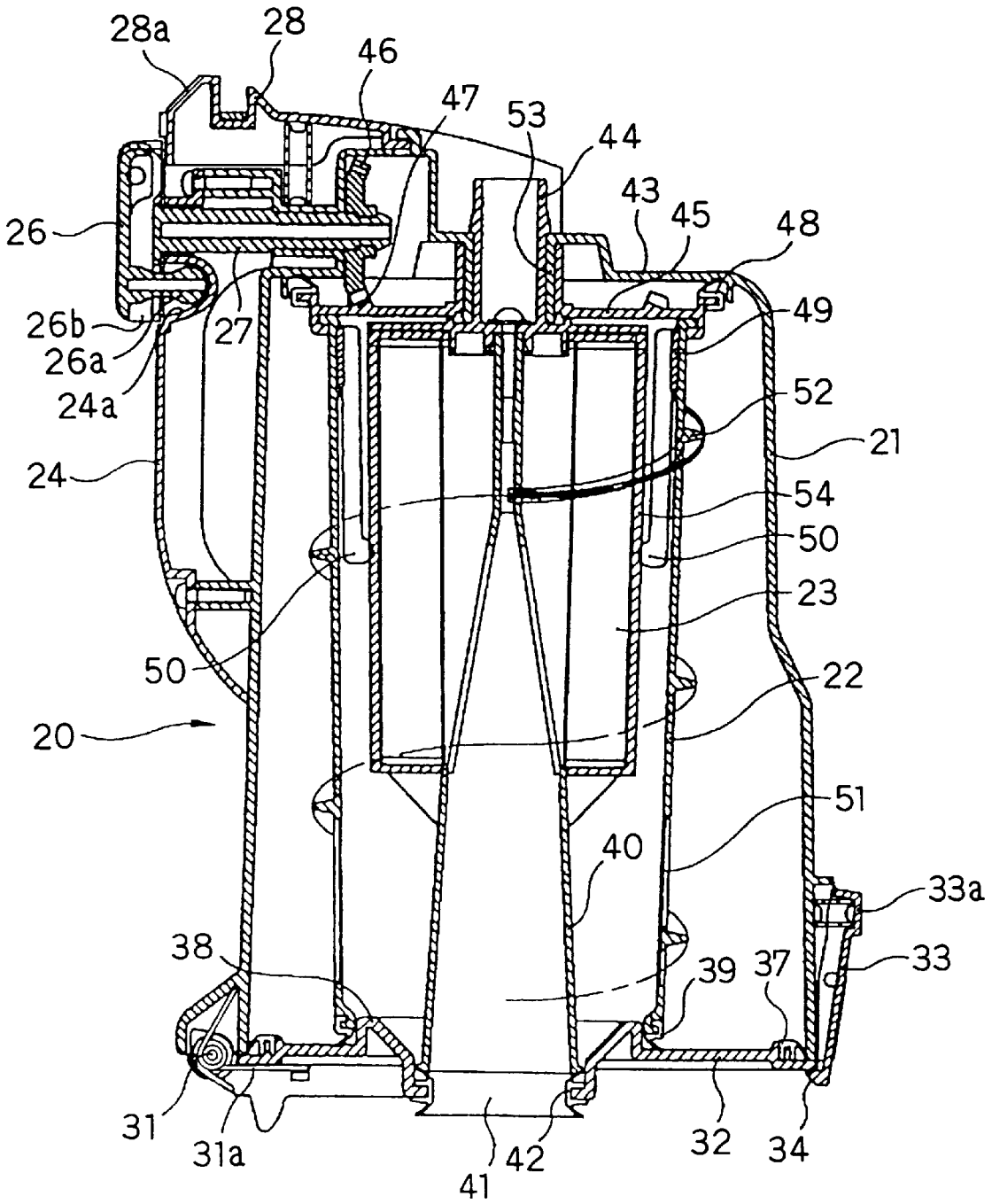
FIG. 15 is a longitudinal sectional view of the dust-collecting device according to another embodiment of the present invention.
Figure 16:
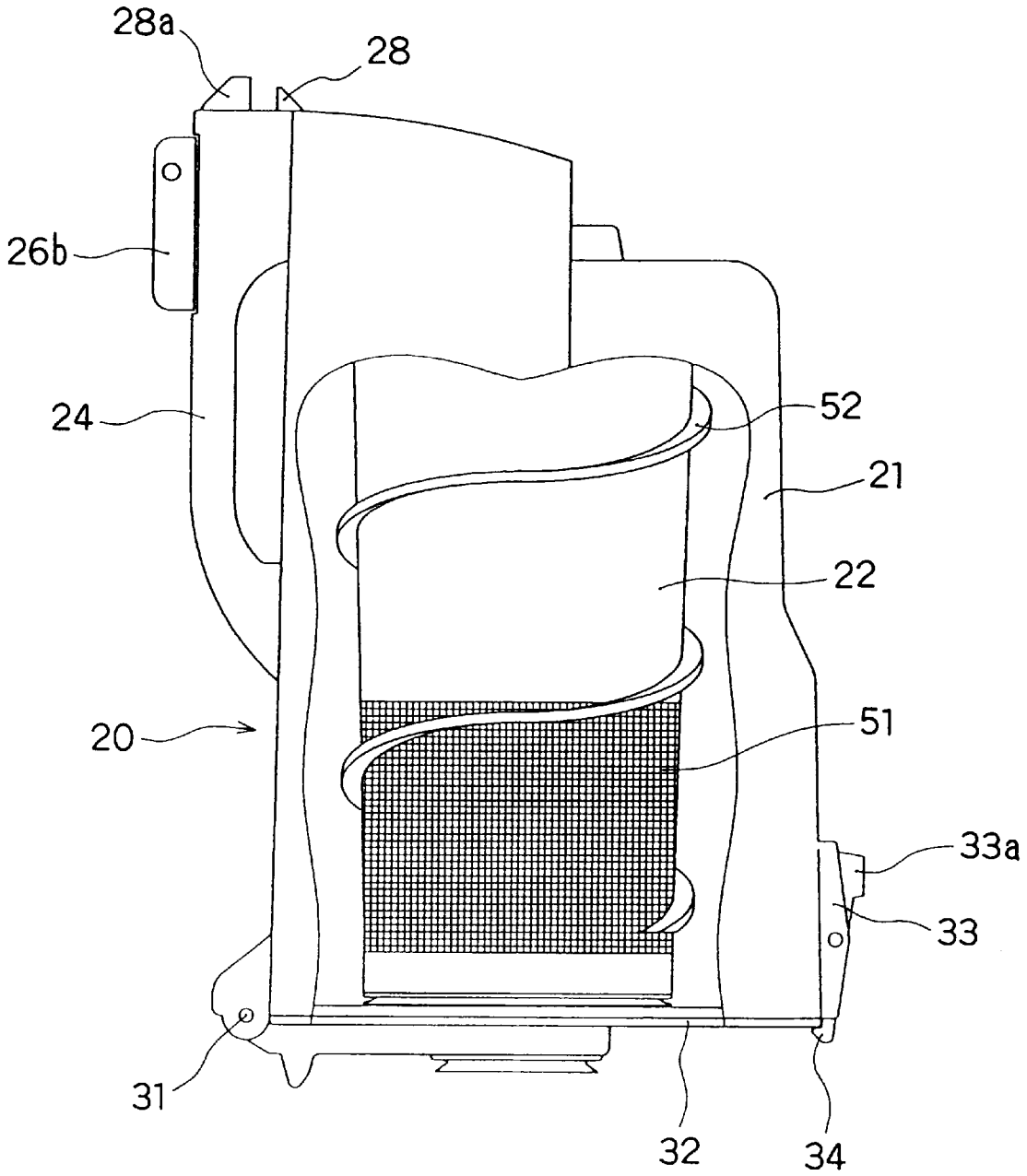
FIG. 16 is a partially cut-away side view of the dust-collecting device according to another embodiment of the present invention.
Figure 17:
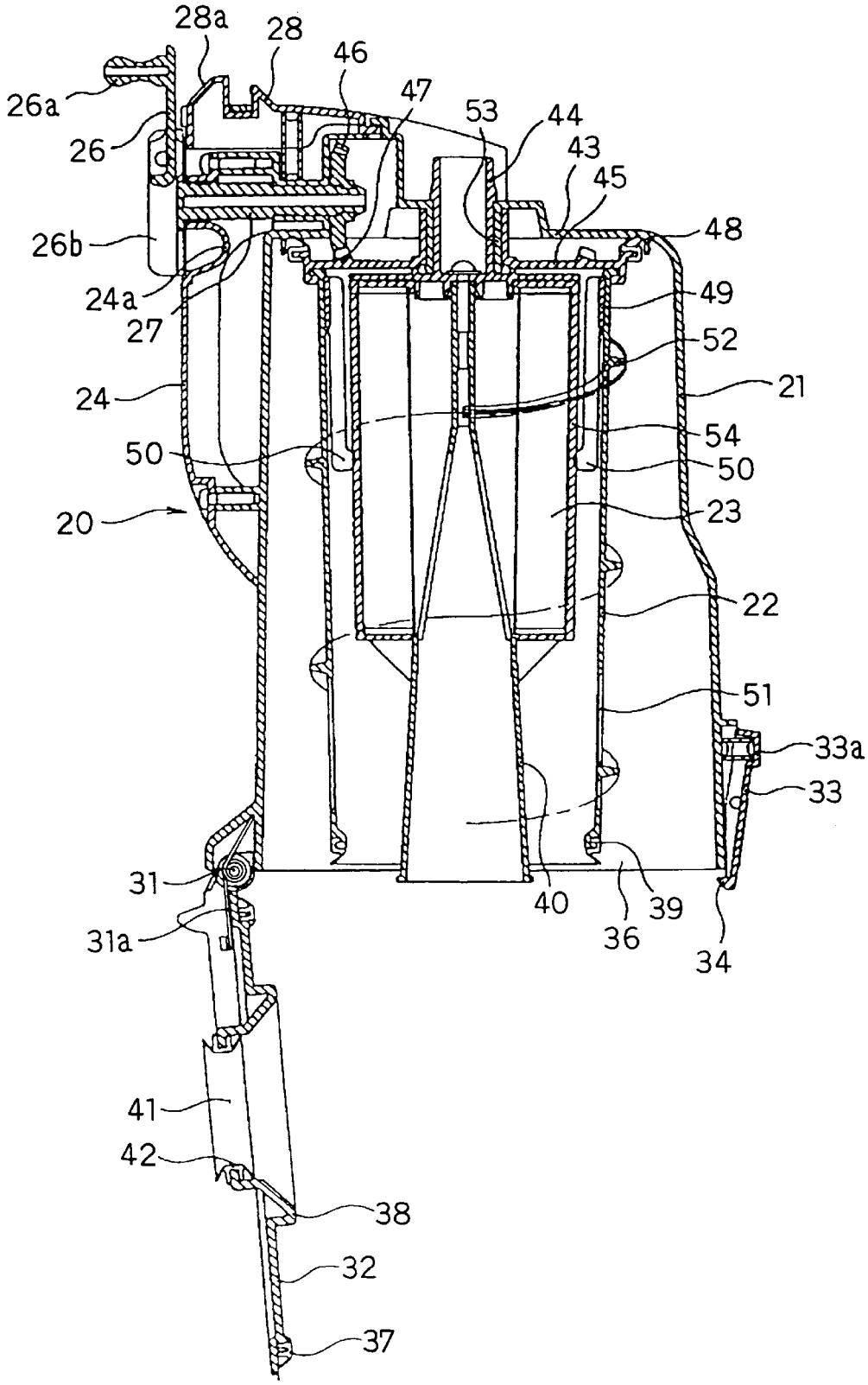
FIG. 17 is a longitudinal sectional view of the dust-collecting device according to another embodiment of the present invention with a bottom lid thereof being in an opened condition.

A handle 26 which is rotatable by hand for rotating the pre-filter 22 is attached to an upper side of the grip 24 in such a manner that it is arranged to be freely foldable in a transverse direction with respect to a rotating axis 27 thereof. That is, as illustrated in FIGS. 15 and 17, the handle 26 is attached to an end of a handle accumulating portion 26*b* uniformly formed with the rotating axis 27 as to substantially form a shape of "T" in a freely foldable manner, and by performing folding from a position ready for use shown in FIG. 17 to a position in an accumulated condition shown in FIG. 15, the handle 26 can be accumulated within the handle accumulating portion 26*b* while a knob 26*a* of the handle 26 is fitted to a concave portion 24*a* formed in an upper portion of the grip 24 to be fixed thereat. With this arrangement, there can be prevented that the handle 26 is erroneously rotated though it is not necessary or that the handle 26 is damaged by hitting against something. Further, it is possible to easily discharge dust accumulated within the dust-collecting case 21 by holding the grip 24, and the handle 26 can also be accumulated by efficiently utilizing the grip 24 which is not needed at the time of performing cleaning.

A clamp 28 to be engaged with the main body 1 when the dust-collecting device 20 is fitted to the main body 1 of the vacuum cleaner is provided on an upper side of the handle 26 of the dust-collecting device 20. This clamp 28 is so arranged that by pressing an operating button (operating portion) 28*a* appearing on the front surface side of the main body 1, the clamp 28 is detached from the main body 1 so as to enable detaching of the dust-collecting device 20 from the main body 1.

Figure 14:
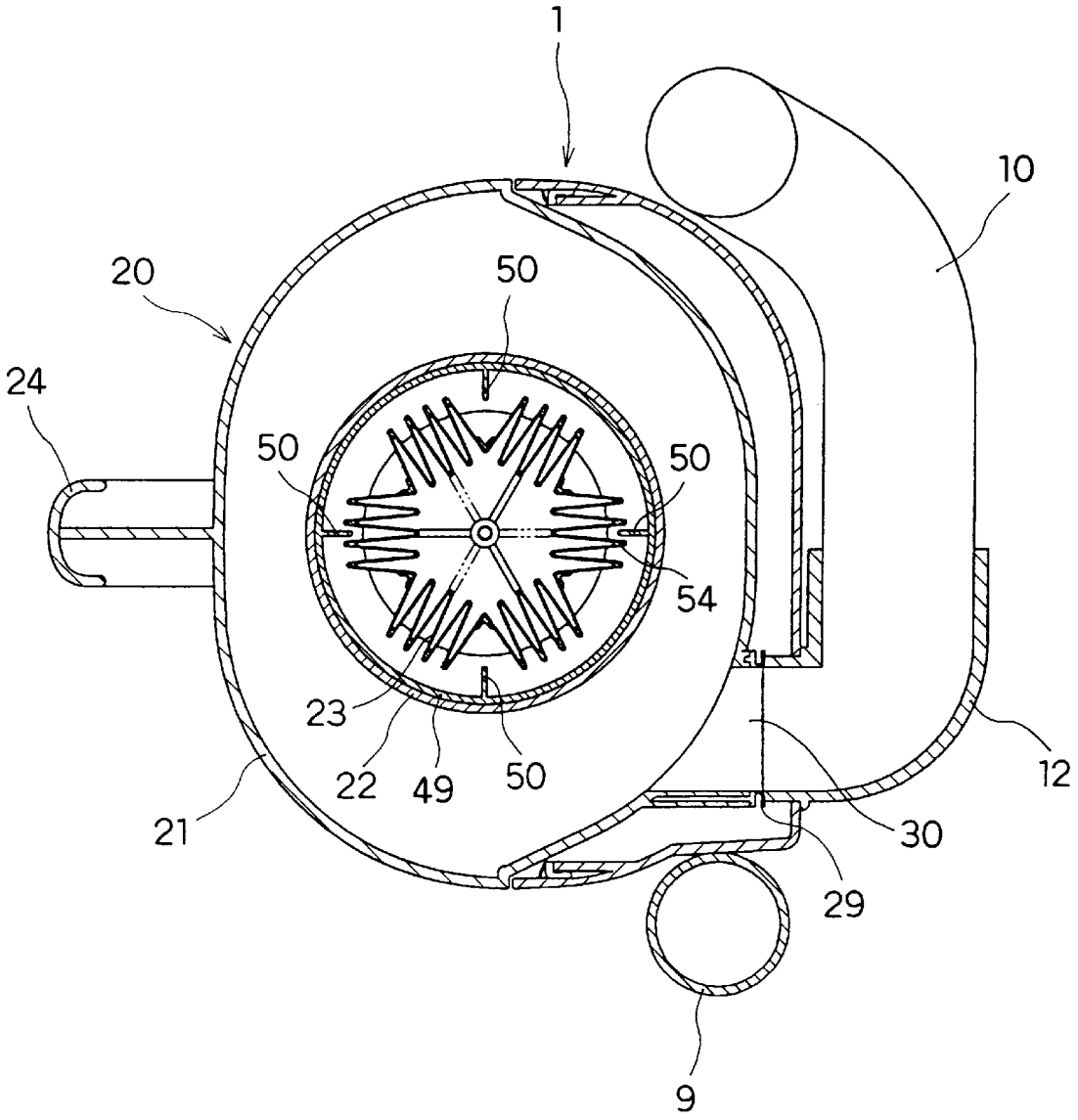
FIG. 14 is a lateral sectional view of the upright type vacuum cleaner utilizing the dust-collecting device according to another embodiment of the present invention.

As shown in FIG. 14, the dust-collecting case 21 is also provided with a suction hole 30 which is sealingly communicated via a packing 29 with an inner aperture of the suction cylinder 12 attached to the rear surface of the main body 1 at a position which is shifted to either side (the opposite side as that of the previous embodiment) on a surface which corresponds to a back side when being fitted to the main body 1 of the vacuum cleaner. By arranging the suction hole 30 of the dust-collecting case 21 to be shifted to either side with respect to a center thereof, air containing dust therein which is sucked through the suction hole 30 can be revolved within the dust-collecting case 21.

Further, to a bottom portion of the dust-collecting case 20, there is attached a bottom lid 32 which is arranged to be freely openable and closable by a hinge 31 provided in a lower portion of the grip 24. The bottom lid 32 is so arranged that by pressing an operating button 33*a* at an upper portion of a lever 33 provided in a lower portion of the grip 24 and opposite to the grip 24, a clamp 34 formed at a lower end of the lever 33 is disengaged from a peripheral edge of the bottom lid 32 to thereby release a discharge outlet 36 for the dust as shown in FIG. 17.

A torsion spring 31*a* is fitted to a hinge 31, to which the bottom lid 32 is attached, for energizing the bottom lid 32 in a releasing direction. A packing 37 for providing close contact with an aperture edge of the dust-collecting case 21 is fitted to an outer peripheral edge of the bottom lid 32.

An annular convex portion 38 for fitting against an inner periphery of a lower aperture of the pre-filter 22 is formed on an upper surface of the bottom lid 32 so as to prevent lateral shift of the lower end portion of the pre-filter 22 owing to rotation. A packing 39 is attached to an aperture end of the pre-filter 22 for providing close contact with the upper surface of the bottom lid 32.

A suction hole 41 to which an aperture side of a lower portion of a cylindrical body 40 forming an air flow passage from the main filter 23 for communicating to an exterior of the dust-collecting case 21 is formed inside of the annular convex portion 38 of the bottom lid 32, wherein a packing 42 is attached to an inner peripheral edge of the suction hole 41 for close contact with an aperture end of the cylindrical body 40 of the main filter 23.

The main filter 23 is attached to a top plate 43 of the dust-collecting case 21 via an attaching shaft 44 which is formed on an upper surface thereof. Between the top plate 43 of the dust collection case 21 and the upper surface of the main filter 23, there is attached an attaching plate 45 of the pre-filter 22 which utilizes the attaching shaft 44 of the main filter 23 as its rotating axis.

On an upper surface of the attaching plate 45 of the pre-filter 22, there is formed an annular bevel gear 47 to be engaged with a disk-like bevel gear 46 attached to the rotating axis 27 of the handle 26 for rotating the filter such that the pre-filter 22 might be rotated corresponding to a rotational direction of the handle 26 for rotating the filter. With this arrangement, the pre-filter 22 can be reliably rotated with a relatively simple arrangement. A packing 48 for providing close contact with the top plate 43 of the dust-collecting case 21 is fitted to an outer peripheral edge of the attaching plate 45 so as to prevent dust from entering the above gear mechanism or the rotating axis.

A cylindrical body 49 made of elastic resin or the like is disposed in an upper portion of the inner periphery of the pre-filter 22, and four pieces of elastic protrusions 50 which abut against a pleats-like tip end portion of the main filter 23 as will be described later are formed at equal intervals on a lower portion side of the cylindrical body 49 as to protrude inwardly. With this arrangement, a front surface side of the main filter 23 to which dust adheres can be repelled such that adhering dust can be more efficiently removed.

The pre-filter 22 is further so arranged that its lower portion side is formed as a mesh 51 so that relatively large-sized dust (coarse dust) can be filtered by this mesh 51. By forming the mesh 51 which composes a filter portion of the pre-filter 22 to be located in lower portion in the dust-collecting case 21, dust which has entered together with air through the suction hole 30 located in an upper portion in dust-collecting case 21 is pushed downward while being revolved at high speed, so that it can be deposited on the bottom surface of the dust-collecting case 21 (bottom lid 32) in a pressed condition.

A spiral rib 52 is formed as to extend in vertical directions on an outer periphery of the pre-filter 22. The spiral rib 52 is so formed that dust which has been accumulated and compressed within the dust-collecting case 21 is pushed out in a direction (opposite direction as that of the previous embodiment) of the discharge outlet 36 when the bottom lid 32 is opened in case the above-described handle 26 for rotating the filter is rotated in a leftward direction.

On the other hand, the main filter 23 is a cylindrically arranged filtering paper having a substantially hexagonal section which is folded in a pleat-like (bellow-like) manner and is disposed above the cylindrical body 40 forming an airflow passage of filtered air, wherein an attaching shaft 44 formed on its upper portion is fitted to an attaching hole 53 formed on the top plate 43 of the dust-collecting case 21 and wherein it is fixed so as not to rotate in accordance with rotating movements of the pre-filter 22.

The pleat-like tip end portion of the main filter 23 is covered with resin 54 for preventing wear owing to contact with the elastic protrusions 50 formed on the inner peripheral side of the pre-filter 22.

It should be noted that air which has been filtered of dust within the dust-collecting device 20 exits through the aperture on the lower portion side of the cylindrical body 40 of the main filter 23 to the exterior of the dust-collecting case 21, and is taken in by the motor fan 6 via a filter 56 shown in FIG. 10 to be exhausted through an exhaust outlet 58 formed on a lower portion of a front surface of the main body 1 of the vacuum cleaner to the exterior by being passed from the motor fan 6 through an exhaust filter 57.

In the upright type vacuum cleaner of the present embodiment, dust which has been scraped up by the rotating brush 5 of the suction nozzle 2 for floors passes through the pipe 9 and the hose 10 into the dust-collecting case 21 through the suction cylinder 12 located to be shifted in either direction with respect to a center of the rear surface side of the main body 1 and is made to flow downward by being revolved along the inner wall thereof while large-sized dust (coarse dust) is deposited on the bottom.

At this time, since the mesh 51 of the pre-filter 22 for sucking air is formed to be located downward within the dust-collecting case 21, dust which has entered together with air through the suction hole 30 located upward within the dust-collecting case 21 is pushed downward by being revolved at a high speed so as to be deposited on the bottom surface (bottom lid 32) of the dust-collecting case 21 in a pressed condition. Such an arrangement is especially effective for flock-like dust, and the compression rate can be improved by several times when compared with cyclone separating type ones as discussed for the prior art. Since the compression rate can be increased in this manner, a lot more dust can be collected even when the dust-collecting capacity remains the same.

Further, small-sized dust (minute dust) enters into the pre-filter 22 by passing through the mesh 51 arranged in the lower portion of the pre-filter 22 and is filtered by the pleats-like main filter 23, so that only clean air enters the main filter 23 to flow downward through the motor fan 6 to be finally exhausted through the exhaust outlet 58 to the exterior.

As explained above, the cylindrical pre-filter 22 arranged in the dust-collecting device 20 of the present embodiment is provided with elastic protrusions 50 which abut against the pleat-like tip end portion (resin 54) of the main filter 23 at four portions on the inner peripheral side of the pre-filter 22 at equal intervals. The outer peripheral surface thereof is provided with a spiral rib 52. Further, the pre-filter 22 is fitted to a lower surface of the attaching plate 45 while the attaching plate 45 is communicated to the handle 26 for rotating the filter via the bevel gears 46, 47.

Therefore, by rotating the handle 26 provided on the front surface of the dust-collecting device 20 (the front surface of the main body 1 of the vacuum cleaner) in an arbitrary direction, the pre-filter 22 is rotated in a corresponding direction by means of the bevel gears 46, 47 and the attaching plate 45. When the pre-filter 22 is rotated, the protrusions 50 formed on the inner side thereof repel the pleat-like tip end portion (resin 54) of the main filter 23 so that minute dust adhering on the surface of the main filter 23 is shaken down through this oscillation to drop downward. Since the pre-filter 22 is simultaneously oscillated through reaction, minute dust adhering to the pre-filter 22 can also be removed. Moreover, since large-sized dust (coarse dust) which is disposited within the dust-collecting case 21 in a compressed condition functions to wipe off minute dust adhering on the outer peripheral surface of the pre-filter 22, the dust removing effects can be further improved. Therefore, degradations in dust-collecting efficiency owing to adhesion of dust to the main filter 23 (and the pre-filter 22) can be effectively prevented.

Further, while large-sized dust (coarse dust) deposited within the dust-collecting case 21 gradually blocks the mesh 51 formed in the lower portion of the pre-filter 22, the spiral rib 52 formed on the outer periphery of the pre-filter is moved up and down owing to the above-described rotation of the pre-filter 22 and acts to form a clearance (airflow passage) between the mesh 51 of the pre-filter 22 and the dust. It is possible to prevent degradation of dust-collecting efficiency also through this arrangement.

Next, for discharge of dust which has been accumulated in the dust-collecting case 21, by holding the grip 24 of the dust-collecting case 21 and drawing the case out with pressing downwardly the operating button 28*a* of the clamp 28 disposed above the grip 24, the dust-collecting case 21 is detached from the main body 1 of the vacuum cleaner.

By pressing the button 33*a* of the lever 33 provided in the lower portion of the dust-collecting case 21 on the opposite side of the grip 24, the clamp 34 is detached whereby the bottom lid 32 is released to enable discharge of dust which has been accumulated in the dust-collecting case 21. At this time, especially flock-like dust adheres to the inner wall of the dust-collecting case 21 in a compressed state so that dust does not easily come off as it is. Thus, the handle 26 is rotated in a specified direction (in this case in a leftward direction) for rotating the pre-filter 22 in a specified direction, the spiral rib 52 provided on the outer periphery of the pre-filter 22 acts to push out dust such as flock-like dust in a compressed state so that easy discharge is enabled.

In addition thereto, since the fulcrum (hinge 31) for opening and closing the bottom lid 32 is provided on the same side as the grip 24 of the dust-collecting case 21, there can be prevented by the bottom lid 32 that dust to be discharged moves to the user holding the grip 24 in case the bottom lid 32 is opened with holding the grip 24 (see FIG. 17), and there can be avoided inconveniences that dust falls on the user.

At the time of performing discharge of dust in the explained manner, the above-described dust removing function is exhibited accompanying the rotation of the pre-filter 22 whereby dust is removed each time discharge of dust is performed without the user being aware of removing dust of the filter, so that degradation of dust-collecting efficiency can be prevented in an unconscious manner.

As explained so far, the device according to the present embodiment can be semi-permanently used without the necessity of using disposable paper packages so as to present advantages that it is economical and that inconveniences of use which were presented when compared with paper packages are improved, whereby there can be obtained a device of remarkably improved convenience of use.

Such a dust-collecting device 20 is favorably used especially with an upright type vacuum cleaner with which a space for fitting can be sufficiently secured due to its vertical structure and of which dust-collecting capacity is also large.

Further, since the upright type vacuum cleaner according to the present embodiment is so arranged, as shown in FIGS. 10 and 12, that its handle 3 for operating the main body is extending upward from the front surface side of the main body 1 of the vacuum cleaner, in case of performing cleaning, for instance an area located under a bed, by inclining the main body 1 rearward at a large angle, a grip portion 3*a* of the handle 3 for operating the main body can be located at a high position so that the user needs not to bend himself or herself down, thereby the user can perform cleaning at an easy posture.

Figure 11:
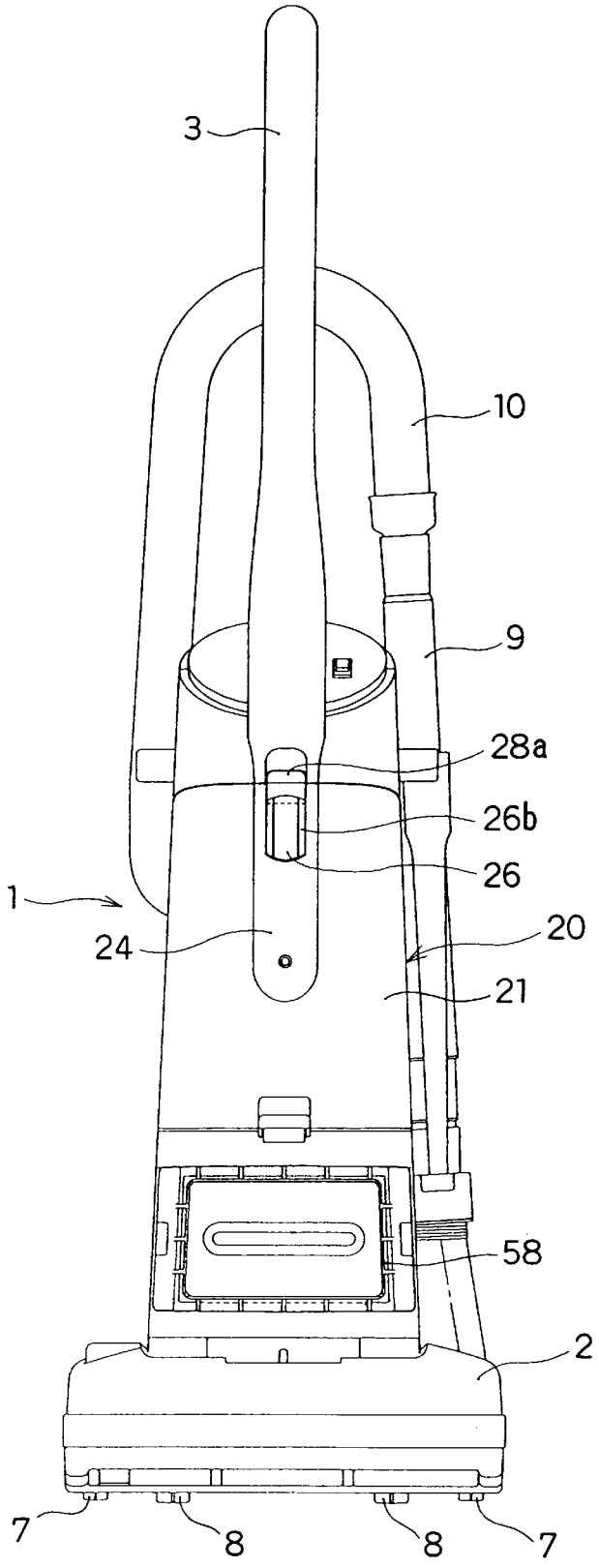
FIG. 11 is a front view of the upright type vacuum cleaner utilizing the dust-collecting device according to another embodiment of the present invention.

In addition, the grip 24 of the dust-collecting device 20 and the handle 3 for operating the main body as well as the handle 26 for rotating the filter and the operating button 28*a* for performing attaching or detaching of the dust-collecting device are aligned on the same line on the front surface of the main body as shown in FIGS. 11 and 12, the device is designed to assume a neat and harmonized appearance.

Figure 18:
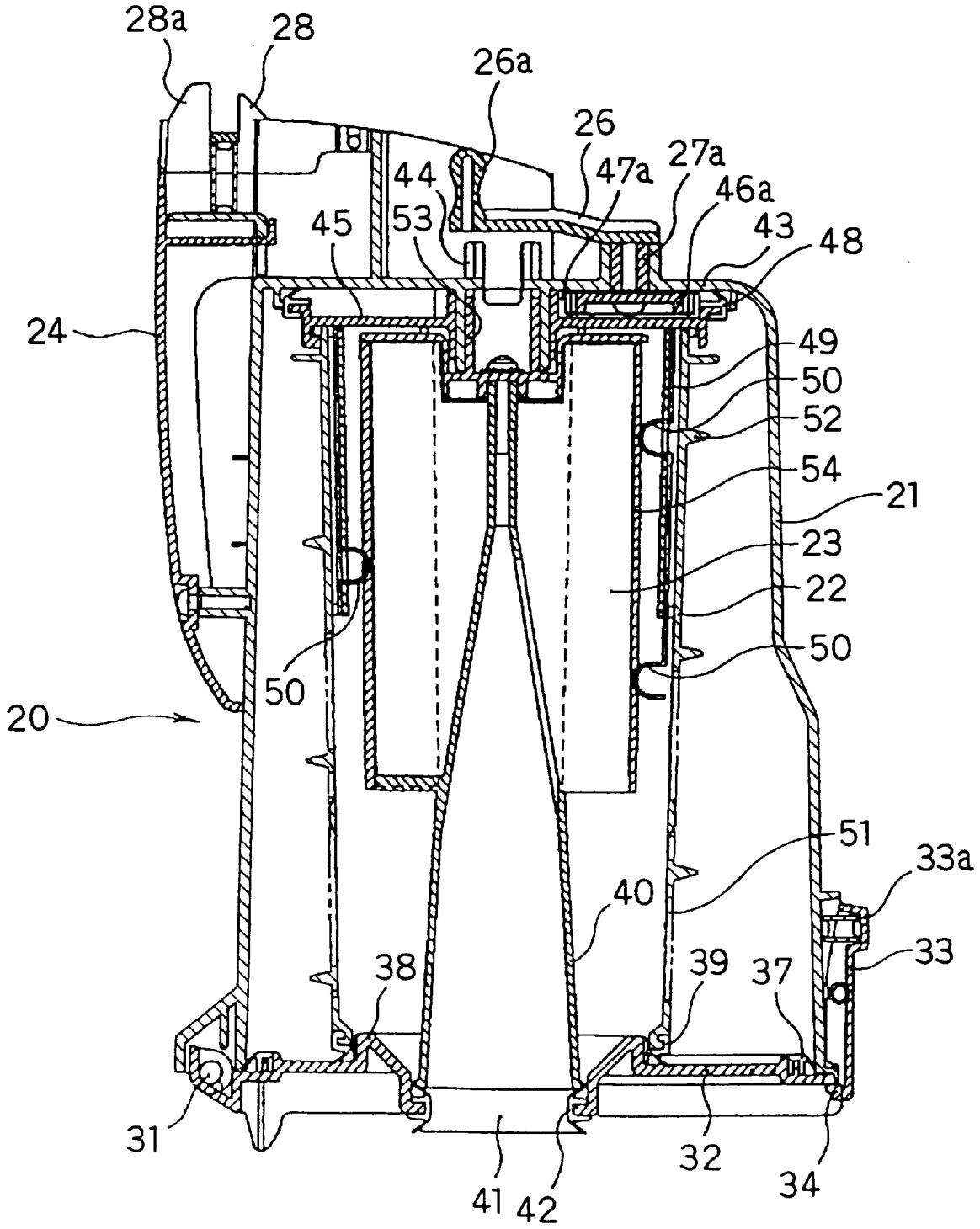
FIG. 18 is a longitudinal sectional view of a dust-collecting device according to still another embodiment of the present invention.
Figure 19:
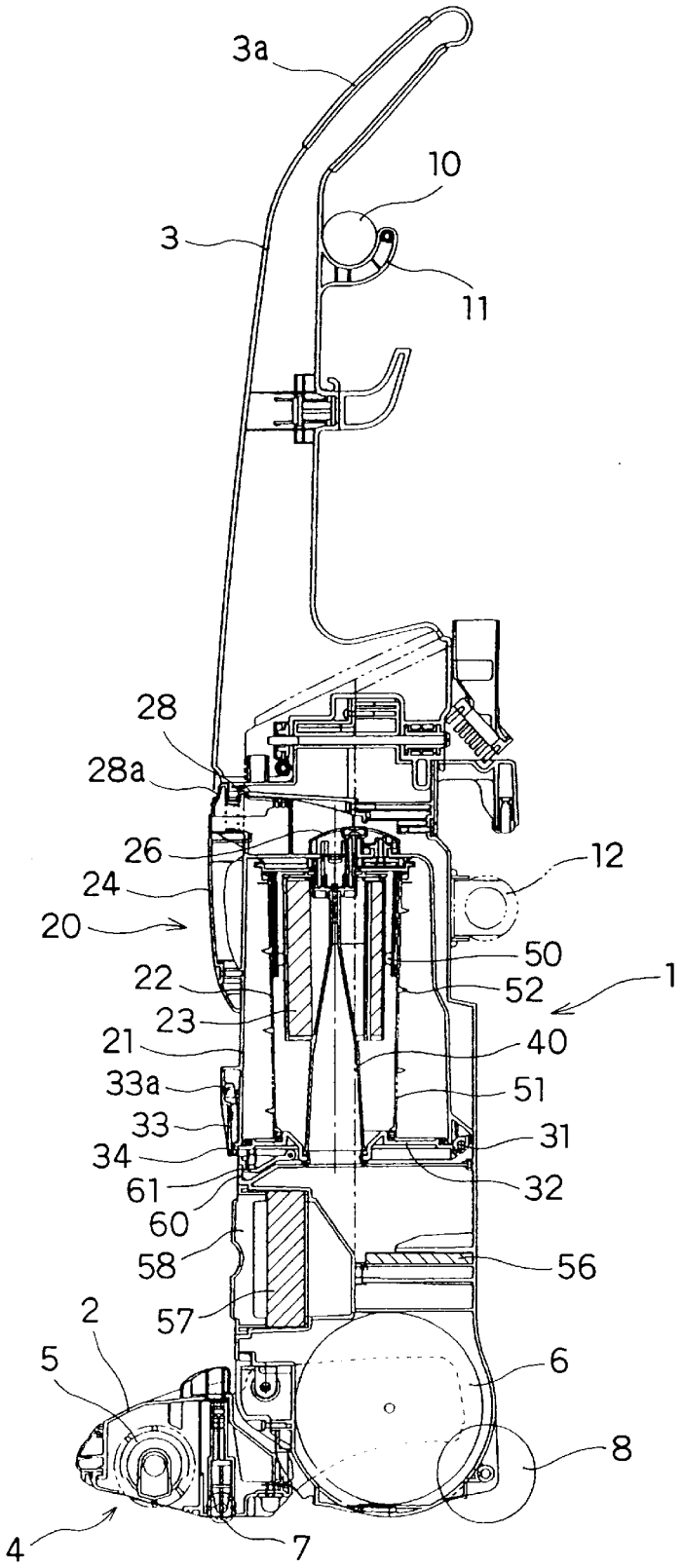
FIG. 19 is a longitudinal sectional view seen from a lateral surface side of an upright type vacuum cleaner utilizing the dust-collecting device according to still another embodiment of the present invention.
Figure 20:
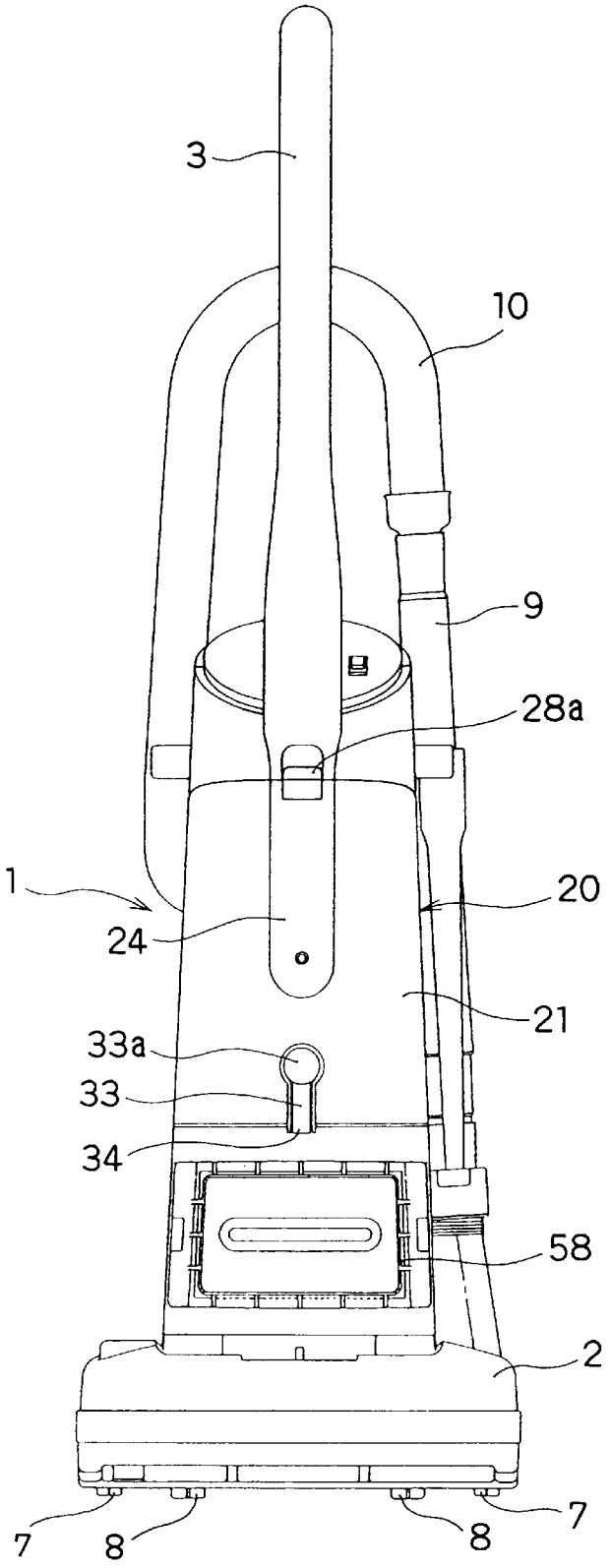
FIG. 20 is a front view of the upright type vacuum cleaner utilizing the dust-collecting device according to still another embodiment of the present invention.
Figure 21:
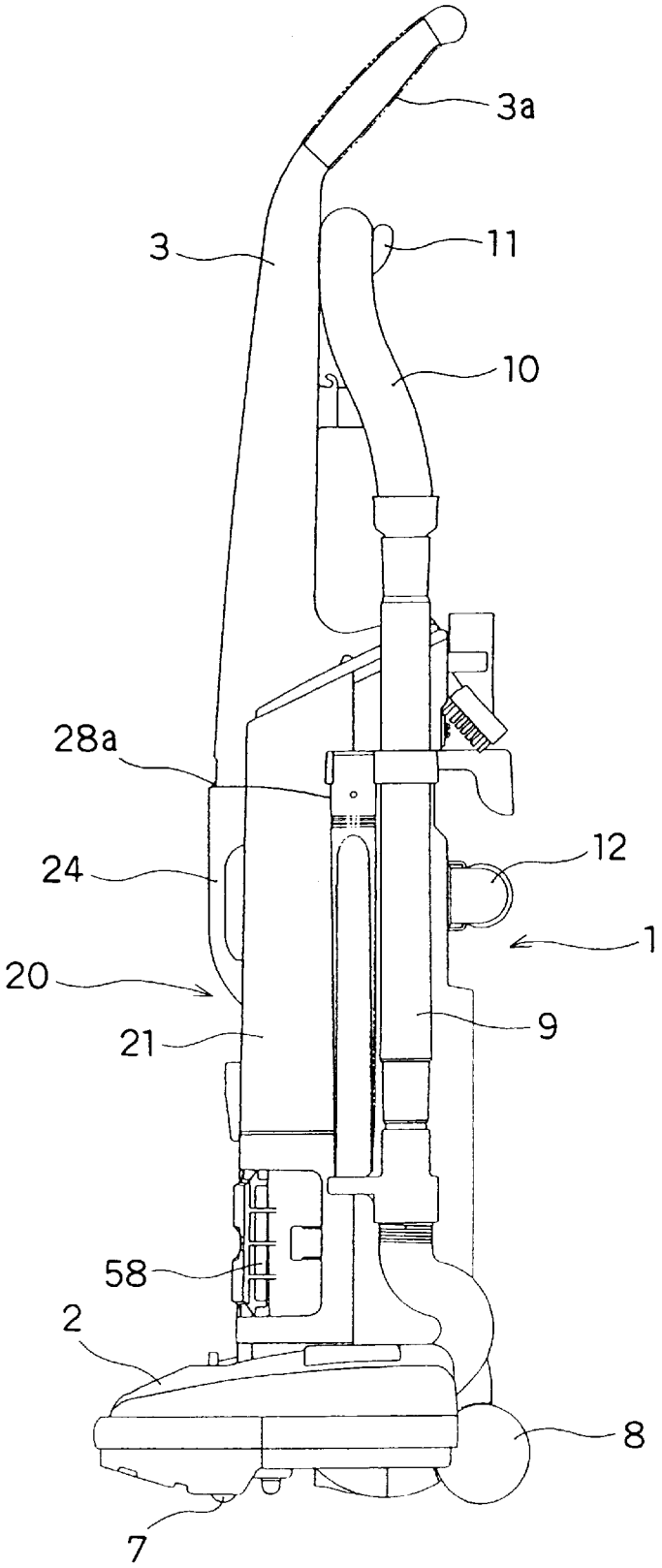
FIG. 21 is a side view of the upright type vacuum cleaner utilizing the dust-collecting device according to still another embodiment of the present invention.
Figure 22:
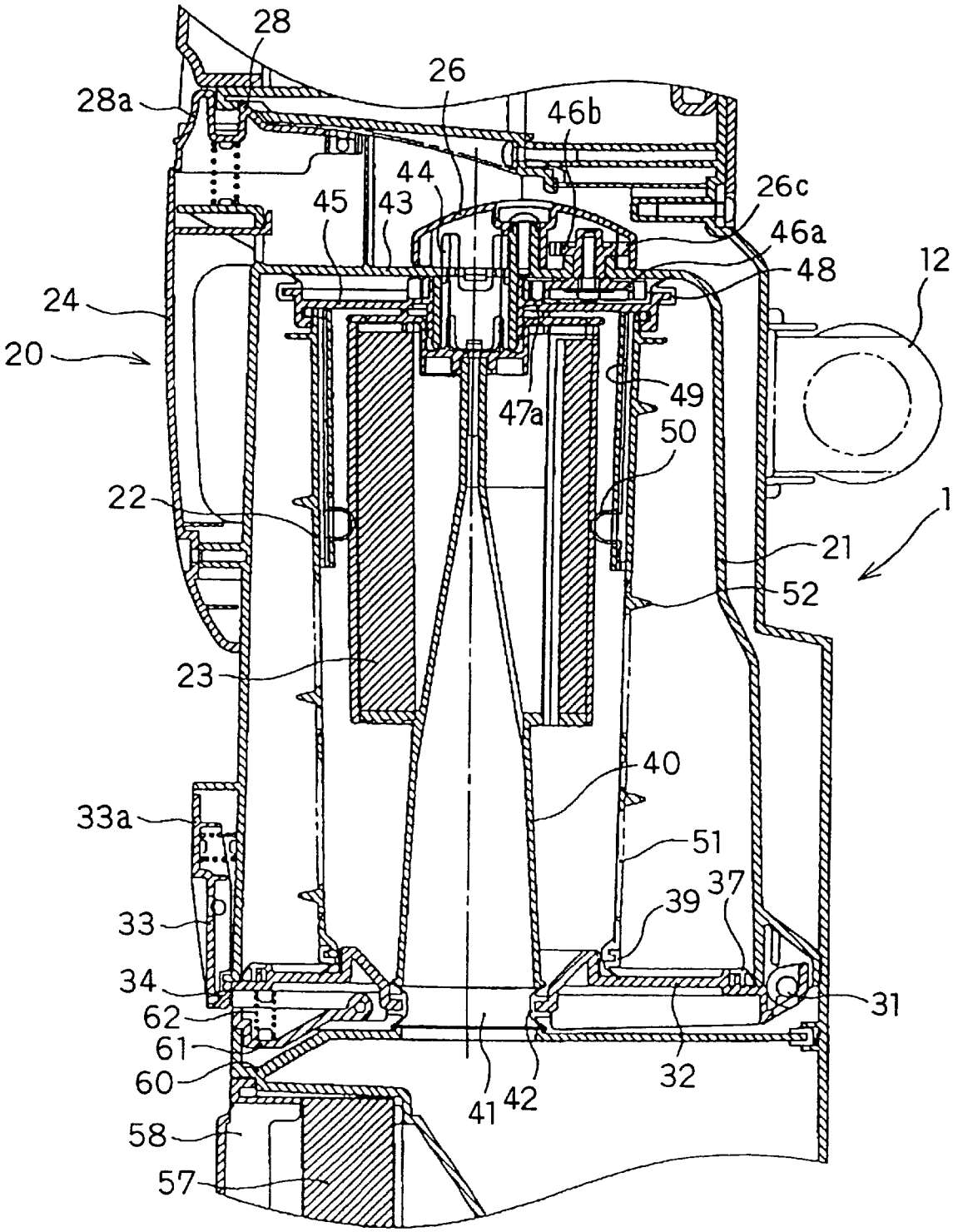
FIG. 22 is a partially enlarged sectional view of FIG. 19.
Figure 23:
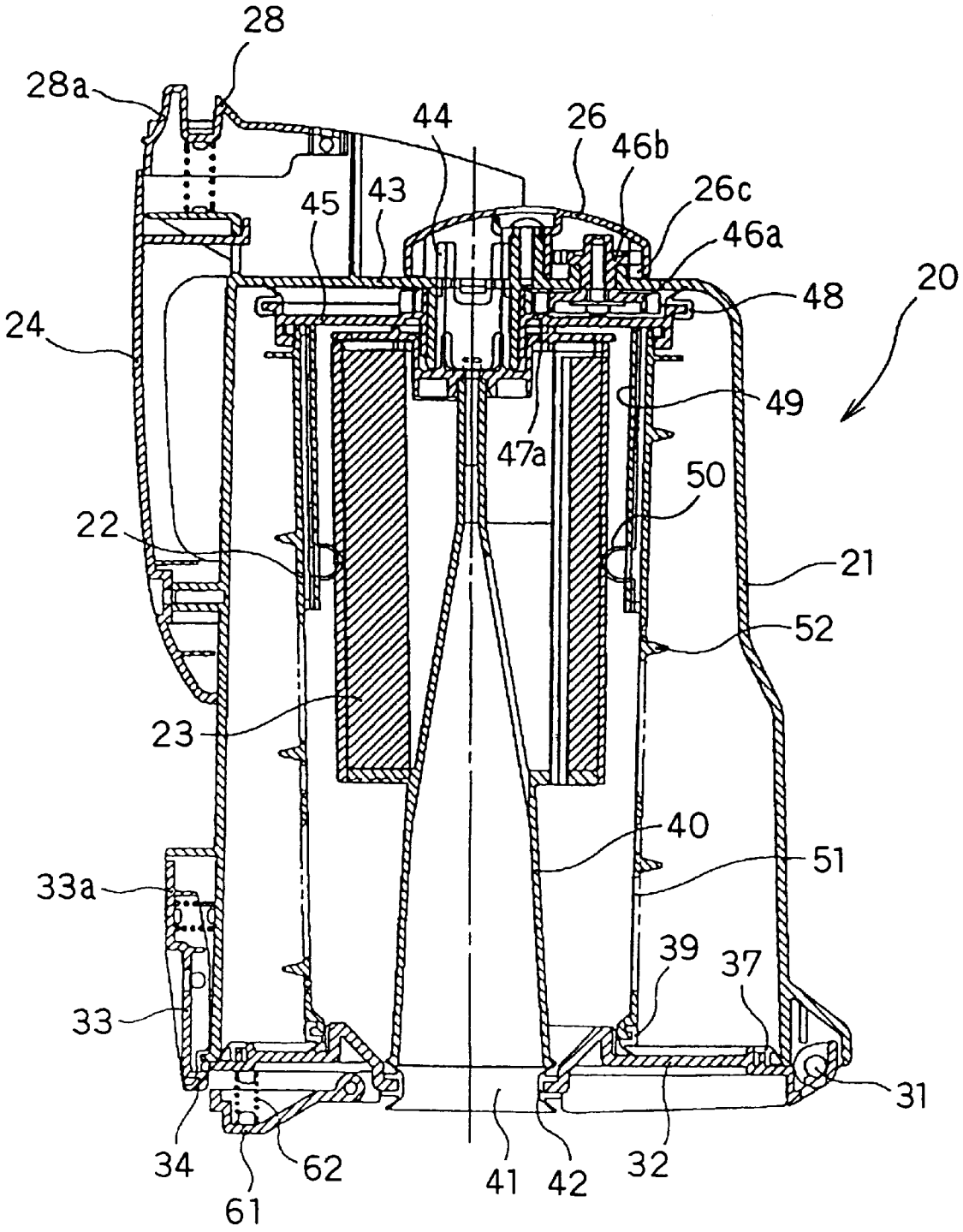
FIG. 23 is a longitudinal sectional view of a dust-collecting device according to still another embodiment of the present invention.

It should be noted that since the handle 26 for rotating the filter is located above of the grip 24 of the dust-collecting device 20 in the present embodiment, it is necessary to hold a lower portion of the grip 24 so as not to interfere with a hand holding the grip 24 when rotating the handle 26. However, in case the handle 26 for rotating the filter is provided on an upper surface of the dust-collecting case 21 as shown in FIG. 18, the handle 26 can be easily rotated irrespective of the location of the hand holding the grip 24.

In this case, a spur gear 46*a* is screwed to another end side of the rotating shaft 27*a* of the handle 26 while a gear 47*a* is formed on an outer periphery of the cylindrical portion of the attaching plate 45 of the pre-filter 22 to be engaged with the spur gear 46*a*. Since the handle 26 is not apparent to the exterior but is hidden when the dust-collecting device 20 is fitted to the main body 1 of the vacuum cleaner, the above-described folding mechanism or handle accumulating portion can be eliminated. Further, since the handle 26 cannot be touched when the dust-collecting device 20 is accumulated within the main body 1 of the vacuum cleaner, it can be prevented that, for instance, children undesirably operate the handle 26.

In this dust-collecting device 20, the elastic protrusions 50 which abut against the pleat-like tip end portion (resin 54) of the main filter 23 are so arranged as to correspond to upper, intermediate and lower portions of the main filter 23, so that oscillation can be applied to the entire surface of the main filter 23 and removal of dust from the main filter can be performed in a more efficient manner.

FIGS. 19 to 25 represent still another embodiment of the present invention wherein reference numerals which are identical to those of the previous embodiment shown in FIGS. 10 to 18 indicate identical or equivalent portions.

The difference between the present embodiment and the previous embodiments lies in the arrangement of the bottom lid 32 of the dust-collecting device 20 and the handle 26 for rotating the filter while the remaining arrangements and functions are similar to those of the previous embodiments.

Figure 24:
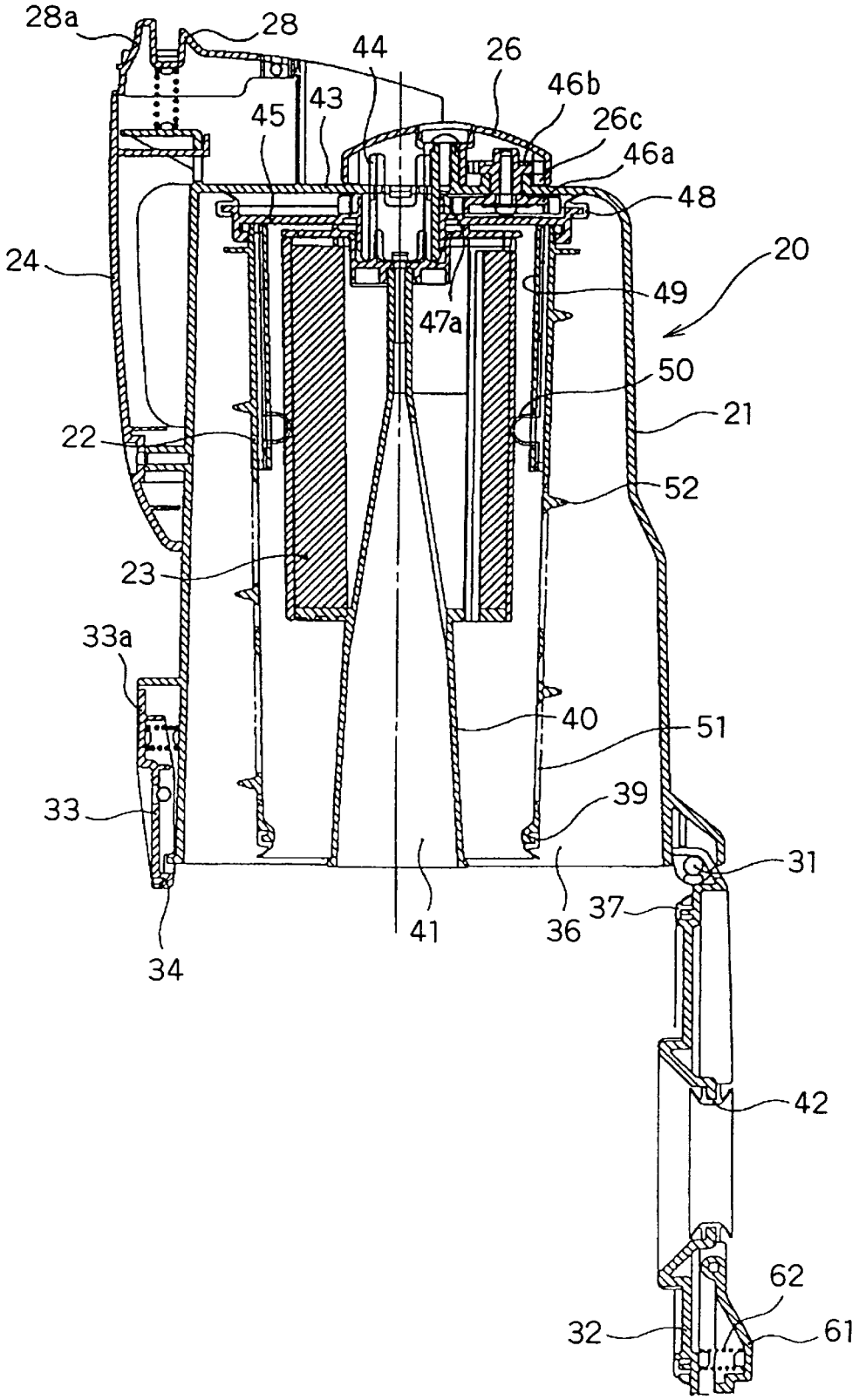
FIG. 24 is a longitudinal sectional view of the dust-collecting device according to still another embodiment of the present invention with a bottom lid thereof being in an opened condition.
Figure 25:
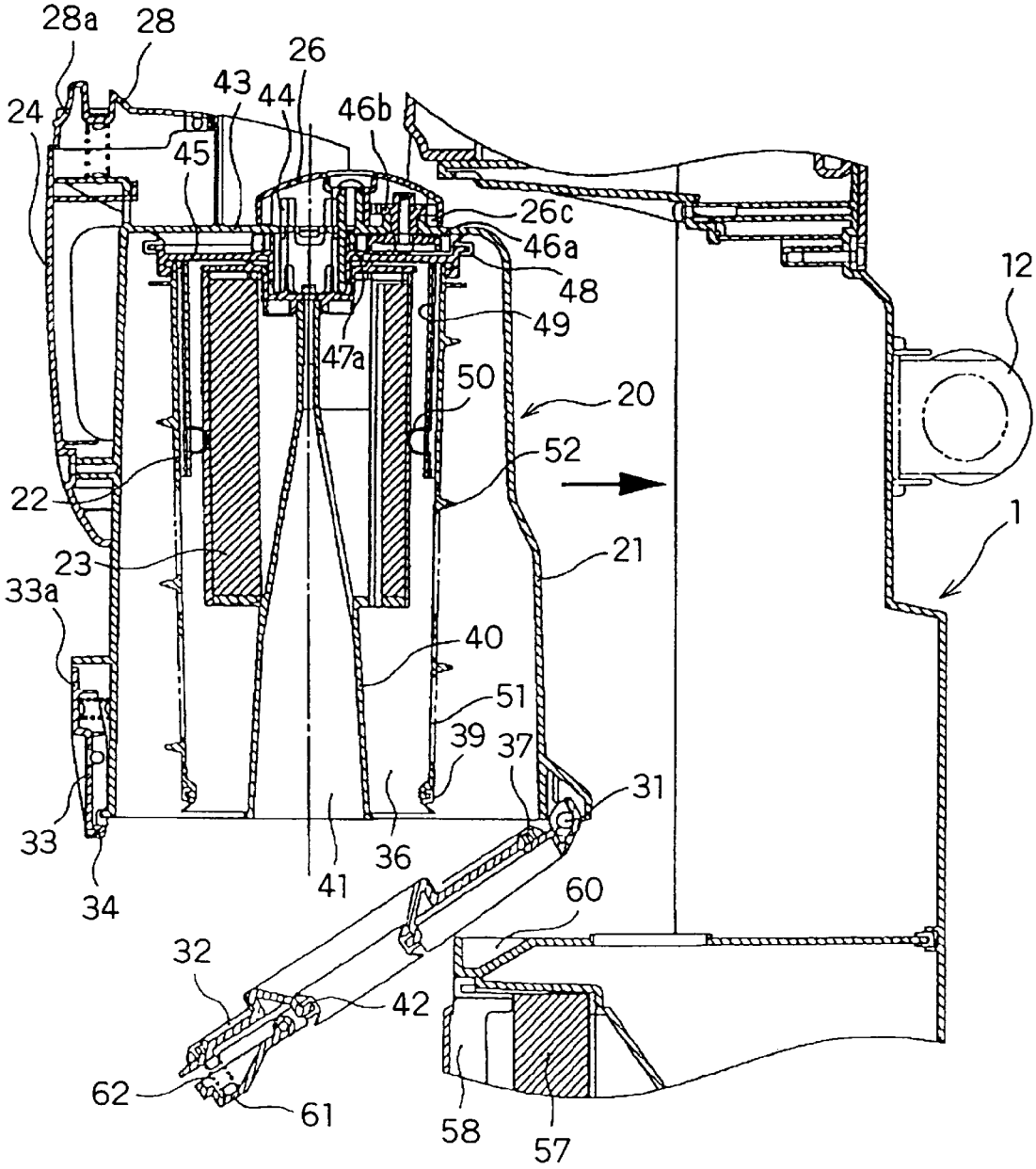
FIG. 25 is a partially enlarged sectional view showing processes for fitting the dust-collecting device according to still another embodiment of the present invention with the bottom lid thereof being in an opened condition to a main body of a vacuum cleaner.

The bottom lid 32 of the present embodiment is so arranged that a fulcrum for opening and closing (hinge 31) is provided at an opposing side of a grip 24 contrary to the previous embodiments, that is, to be located at a back side of a main body 1 of a vacuum cleaner. By pressing an operating button 33*a* formed on a lever 33 for opening and closing the bottom lid provided in the lower portion of the grip 24, a clamp 34 formed on a lower end of the lever 33 is detached from a peripheral edge of the bottom lid 32 so as to release a discharge outlet 36 for dust as shown in FIG. 24.

On a lower surface of the bottom lid 32 on the side of the grip 24, there is attached a convex member 61 which fits into a concave portion 60 formed on a bottom surface of an attaching portion on the side of the main body of which one end is axially supported in a rotatable manner and energized downward by means of a coil spring 62. The convex member 61 is formed to assume a sloped surface on a side from which the dust-collecting device is inserted into the main body, and by inserting the dust-collecting device 20 into the main body 1 in a horizontal condition, the sloped surface abuts against a front edge of the main body to be dented so that it can be inserted as it is, and in case the dust-collecting device is completely inserted, the convex member 61 returns to the extruding condition to be fitted against the concave portion 60 of the main body to be locked thereat.

In the above arrangement, for discharge of dust which has been accumulated in the dust-collecting case 21, by holding the grip 24 on the front surface and pulling it with pressing the operating button 28*a* on the clamp 28 for attaching and detaching the dust-collecting device located above the grip downward, the dust-collecting device 20 is detached from the main body 1 of the vacuum cleaner.

Then, by pressing the operating button 33*a* of the lever 33 for opening and closing the bottom lid located in the lower portion of the grip 24, the clamp 34 is detached whereby the bottom lid 32 is released to enable discharge of dust which has been accumulated the dust-collecting case 21.

At the time of fitting the dust-collecting device 20 after discharge of dust to the main body 1 of the vacuum cleaner, the dust-collecting device 20 is horizontally inserted into the main body 1 while the bottom lid 32 can be automatically closed accompanying the insertion even if the bottom lid 32 is in an opened condition since the fulcrum (hinge 31) for opening and closing the bottom lid is located at the back side, thereby the bottom lid 32 can be locked by the clamp 34 for opening and closing the bottom lid.

When the dust-collecting device 20 is completely fitted to the main body 1, the dust-collecting device 20 is locked to the main body 1 so that it cannot be detached therefrom owing to the clamp 28 for attaching and detaching the dust-collecting device and the convex member 61 which is formed on the lower surface of the bottom lid 32.

As explained so far, since the dust-collecting device of the present embodiment can be fitted to the main body 1 of the vacuum cleaner without touching the bottom lid 32 soiled by dust or the like at the time of discharge of dust, the device might be used in a hygienic manner without making one's hand dirty.

Further, the previous embodiments are so arranged that the convex portion uniformly formed with the bottom lid 32 is fitted into the concave portion on the bottom surface of the attaching portion, and thus for fitting the dust-collecting device 20 to the main body 1, the grip 24 is inclined forward with the bottom lid 32 of the dust-collecting device 20 being in a closed condition to fit the convex portion on the lower surface of the bottom lid 32 into the concave portion on the side of the main body 1 and to raise the dust-collecting device 20 with this point being the fulcrum for completing fitting to the main body 1. Thus, when fitting the convex portion on the lower surface of the bottom lid 32 into the concave portion on the side of the main body, this portion is hardly visible and fitting becomes difficult unless being accustomed to that. In contrast to that, the dust-collecting device 20 might be simply fitted in a horizontal condition as stated above in this embodiment, so that fitting of the dust-collecting device 20 to the main body 1 becomes easy.

The handle 26 for rotating the filter according to this embodiment is of cap-like shape which is attached on the upper surface of the dust-collecting case 21 in a rotatable manner and which incorporates therein a spur gear 46*b* engaging with an internal gear 26*c* formed on an inner periphery thereof. A spur gear 46*a* is screwed to another side of a rotating shaft of the spur gear 46*b* (rear surface side of a top plate 43 of the dust-collecting case) and a gear 47*a* engaging with the spur gear 46*a* is formed on an outer periphery of a cylindrical portion of an attaching plate 45 of a pre-filter 22. Similarly to that shown in FIG. 18, since the handle 26 is not apparent to the exterior but is hidden when the dust-collecting device 20 is fitted to the main body 1 of the vacuum cleaner, the above-described folding/mechanism or handle accumulating portion can be eliminated. Further, since the handle 26 cannot be touched when the dust-collecting device 20 is accumulated within the main body 1 of the vacuum cleaner, there can be prevented that, for instance, children undesirably operate the handle 26. Moreover, since there are no protruding objects such as a knob 26*a* compared to the example shown in FIG. 18, there can be prevented that the device is caught at the time of fitting the same to the main body 1, thereby enabling smooth fitting.

Figure 26:
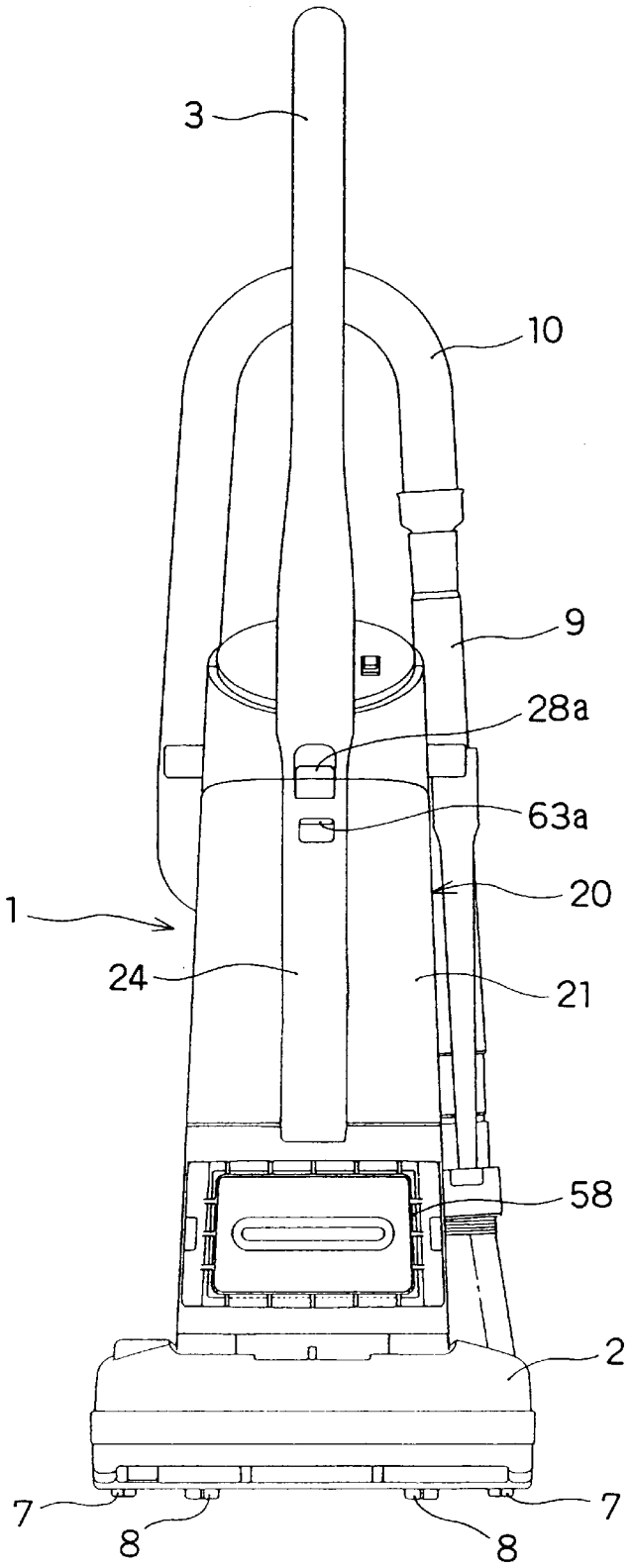
FIG. 26 is a front view of an upright type vacuum cleaner utilizing the dust-collecting device according to yet another embodiment of the present invention.
Figure 27:
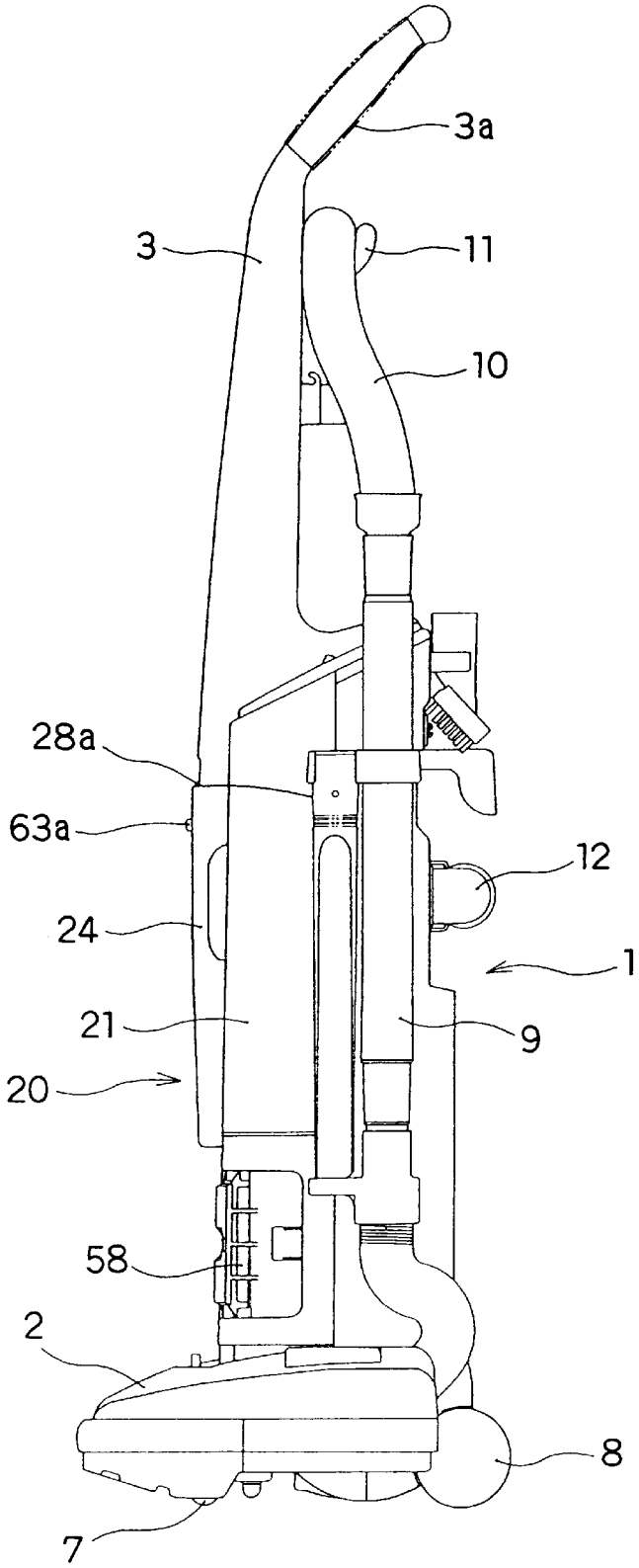
FIG. 27 is a side view of the upright type vacuum cleaner utilizing the dust-collecting device according to yet another embodiment of the present invention.
Figure 28:
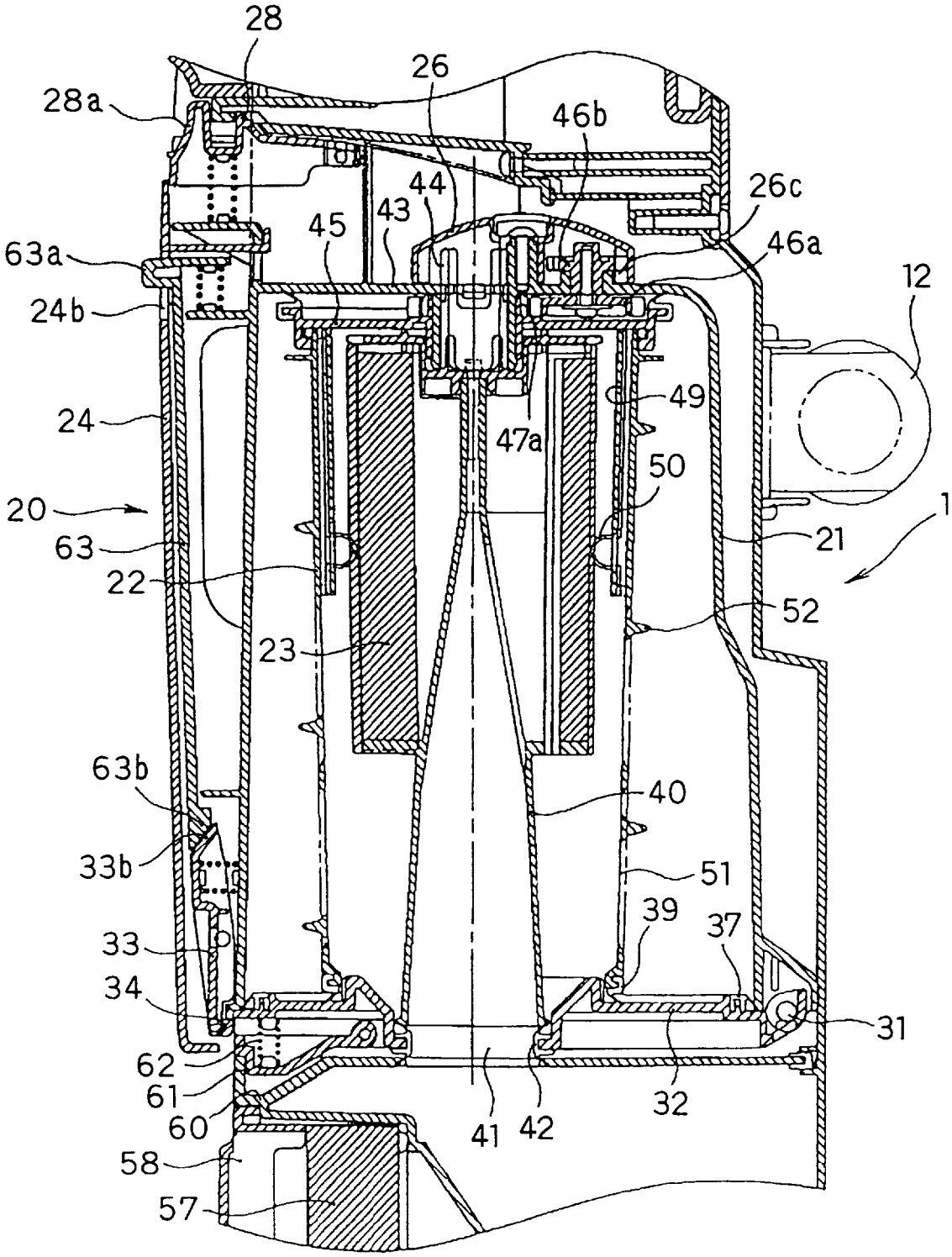
FIG. 28 is a partially enlarged sectional view of the dust-collecting device according to yet another embodiment of the present invention.

FIGS. 26 to 28 are drawings representing a modified example of the above-described embodiment wherein operations from attaching and detaching of the dust-collecting device 20 up to discharge of dust can be performed by using one hand only.

For this purpose, a grip 24 of the present embodiment is extended up to a position at which it covers a rotating lever 33 for opening and closing a bottom lid located therebelow. A separate lever 63 for releasing the bottom lid is disposed in the grip 24, an operating portion 63*a* which is exposed from an aperture 24*b* formed on an upper portion of the grip 24 is provided at a top end thereof, and a pressurizing portion 63*b* for pressurizing a sloped surface 33*b* formed on an upper portion of the rotating lever 33 for opening and closing the bottom lid is provided at a bottom end thereof.

In the above arrangement, for discharge of dust which has been accumulated in the dust-collecting case 21, by holding the grip 24 on the front surface and pulling the device 20 with pressing downwardly an operating button 28*a* of a clamp 28 for attaching and detaching the dust-collecting device located in the upper portion of grip 24 by a thumb, the dust-collecting device 20 is detached from the main body 1 of the vacuum cleaner.

Then, by pressing the operating portion 63*a* of the lever 63 for releasing the bottom lid 63 provided on an upper portion of the grip 24 downward by the thumb, the pressing portion 63*b* formed on the lower end thereof presses the upper sloped surface 33*b* of the rotating lever 33 for opening and closing the bottom lid to thereby rotate the lever 33 and to detach the clamp 34 at the lower end thereof, so that the bottom lid is released to enable discharge of dust which has been accumulated in the dust-collecting case 21.

At the time of fitting the dust-collecting device 20 after discharge of dust to the main body 1 of the vacuum cleaner, the dust-collecting device 20 is horizontally inserted into the main body 1 while the bottom lid 32 can be automatically closed accompanying the insertion even if the bottom lid 32 is in an opened condition since the fulcrum (hinge 31) for opening and closing the bottom lid is located at the back side, thereby the bottom lid 32 can be locked by the clamp 34 for opening and closing the bottom lid.

Further, when the dust-collecting device 20 is completely fitted to the main body 1, the dust-collecting device 20 is locked to the main body 1 so that it cannot be detached therefrom owing to the clamp 28 for attaching and detaching the dust-collecting device and the convex member 61 which is formed on the lower surface of the bottom lid 32.

Therefore, all of the operations from attaching and detaching the dust-collecting device 20 up to discharge of dust can be performed by a single hand holding the grip 24 in the present embodiment so that the operatability thereof is further improved.

FIGS. 29 to 33 represent still another embodiment of the present invention wherein reference numerals that are identical to those of the previous embodiment shown in FIGS. 10 to 18 indicate identical or equivalent portions.

The difference between the present embodiment and the above-described embodiment illustrated in FIGS. 10 to 18 lies in the arrangement of the filter rotating means while the remaining arrangement and functions are similar to those of the previous embodiment.

Figure 29:
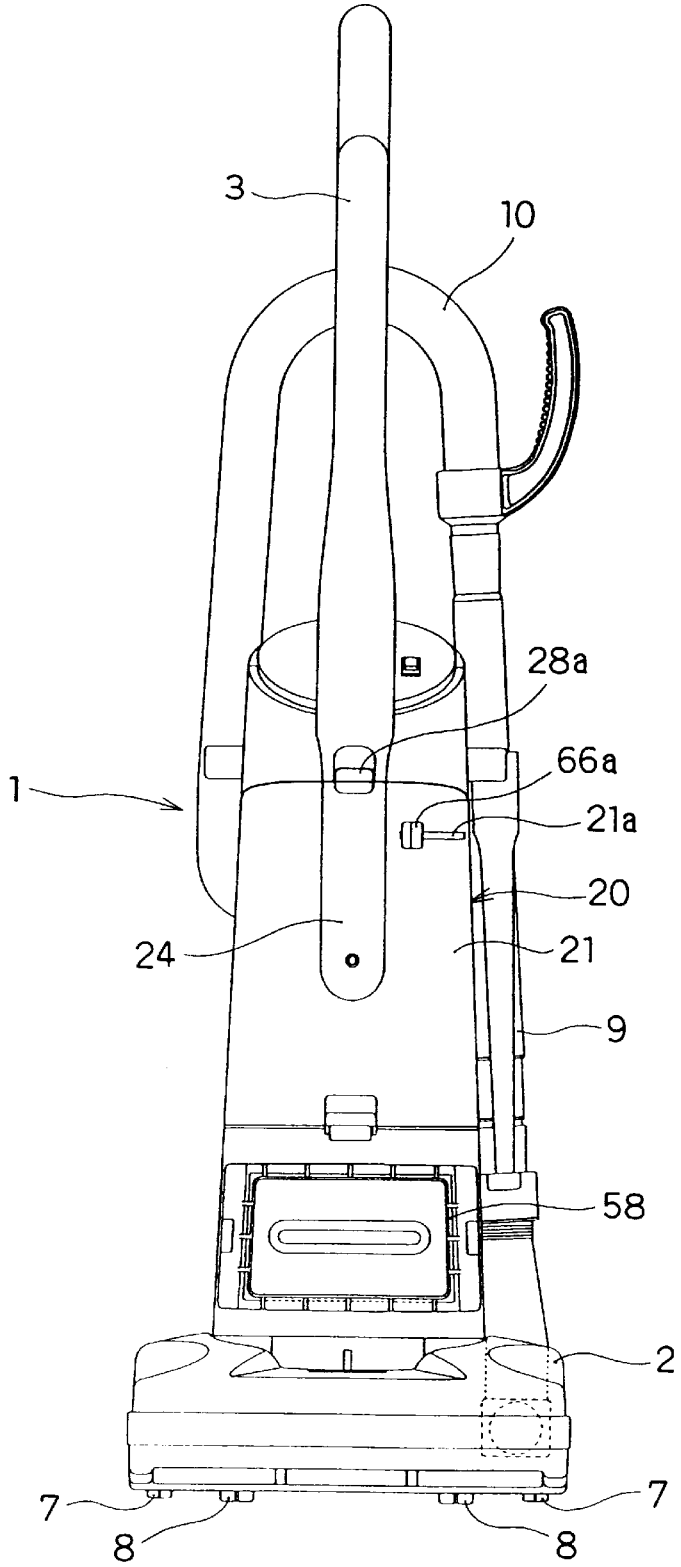
FIG. 29 is a front view of an upright type vacuum cleaner utilizing the dust-collecting device according to still another embodiment of the present invention.
Figure 30:
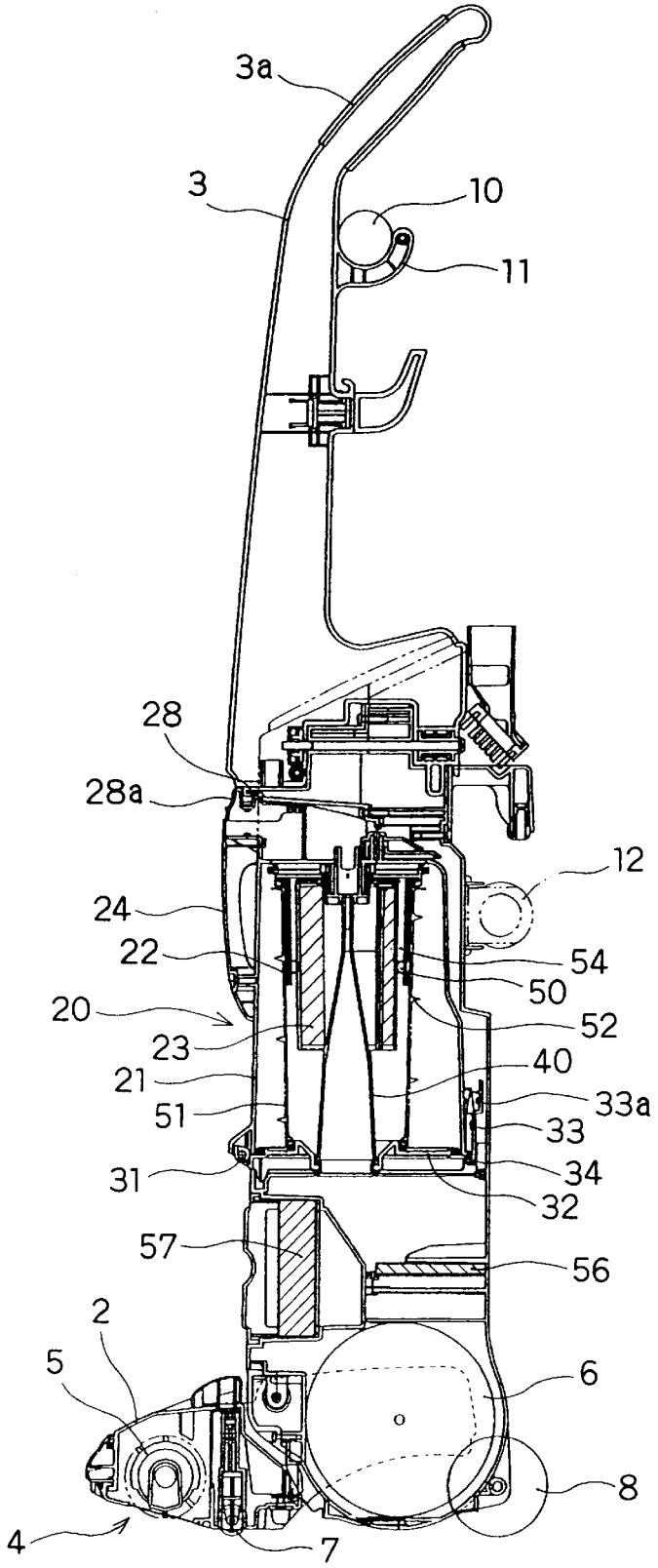
FIG. 30 is a longitudinal sectional view seen from a lateral surface side of the upright type vacuum cleaner utilizing the dust-collecting device according to still another embodiment of the present invention.

In the present embodiment, a slide lever 66 is employed for rotating the filter. As shown in FIG. 29, one end of the slide lever 66 is exposed from a slide hole 21*a* formed in a lateral direction on an upper portion on a lateral side on the side of a grip 24 of a dust-collecting device 20 to compose an operating knob 66*a*, and the other end thereof is attached through a torsion spring 67 to a fulcrum 66*b* formed on a top plate 43 of a dust-collecting case 21 as shown in FIG. 31.

A portion of the slide lever 66 between a portion proximate of a center of the slide lever 66 to the fulcrum 66 is formed in a bent manner as to surround a side of axes of two spur gears 68*a*, 46*c* disposed on the top plate 43, and an arc-like internal gear 66*c* is formed on a part thereof. The axis of the spur gear 68*a* which is the one that engages with the internal gear 66*c* is attached to a substantially elliptic bearing 68*c* to be movable within a specified scope for engagement with the other spur gear 46*b*. These gears 46*b*, 66*c*, 68*a* are covered with a protecting cover 69.

Figure 31A:
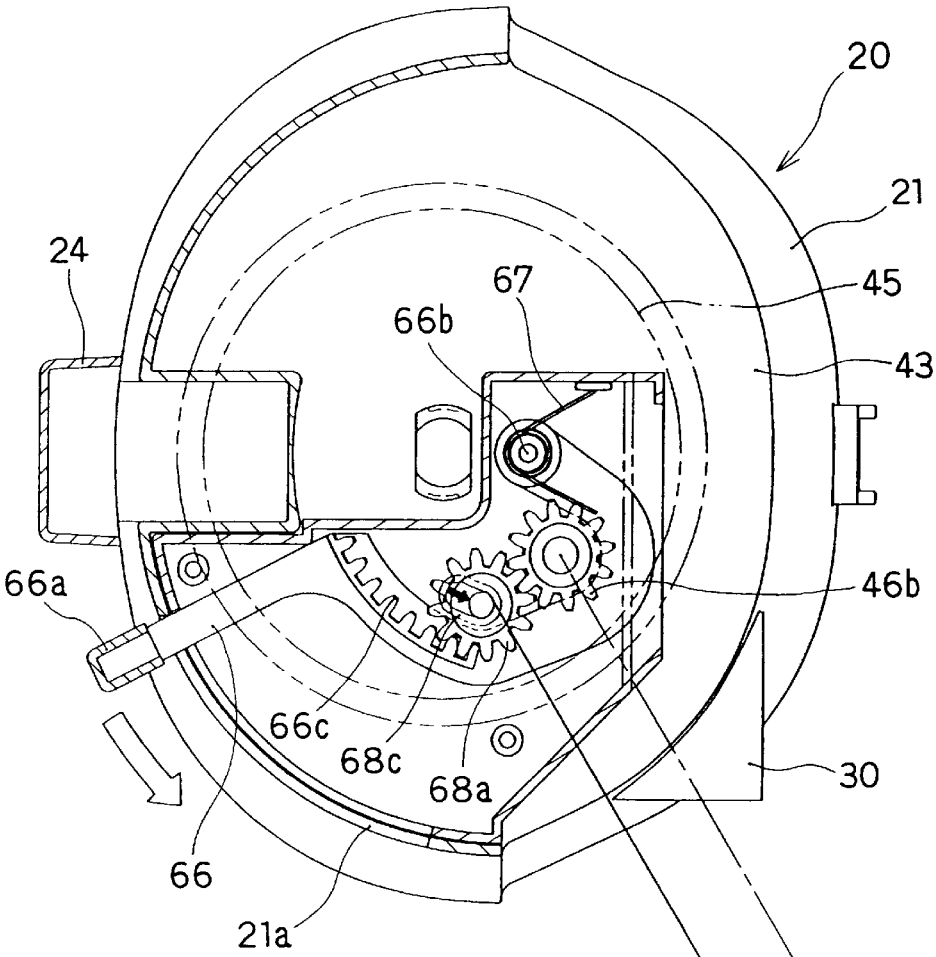
FIG. 31(*a*) and FIG. 31(*b*) are views showing a slide lever and a gear mechanism of the dust-collecting device according to the still another embodiment of the present invention wherein FIG. 31(*a*) is a view of an upper step arrangement of the gear mechanism and FIG. 31(*b*) a longitudinal sectional view of a main part thereof.
Figure 31B:
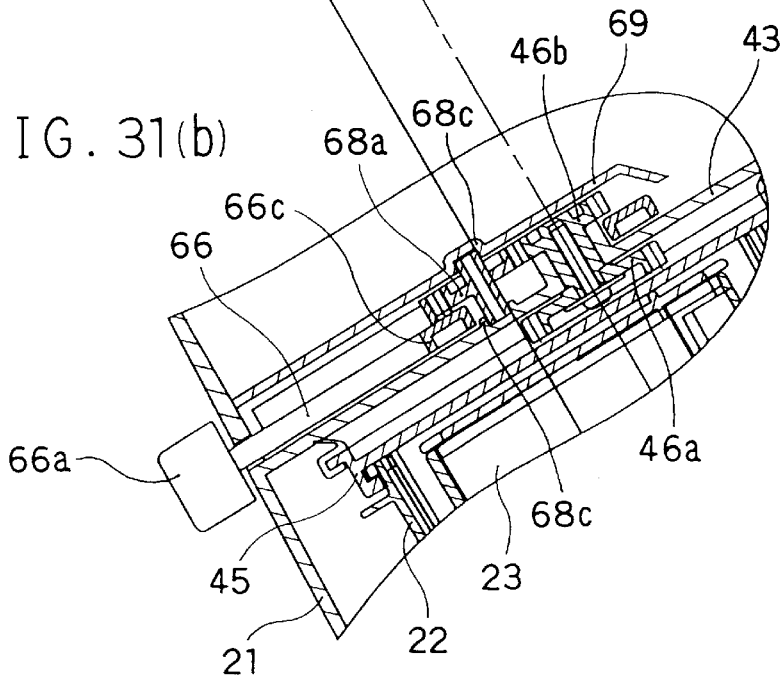
Figure 32:
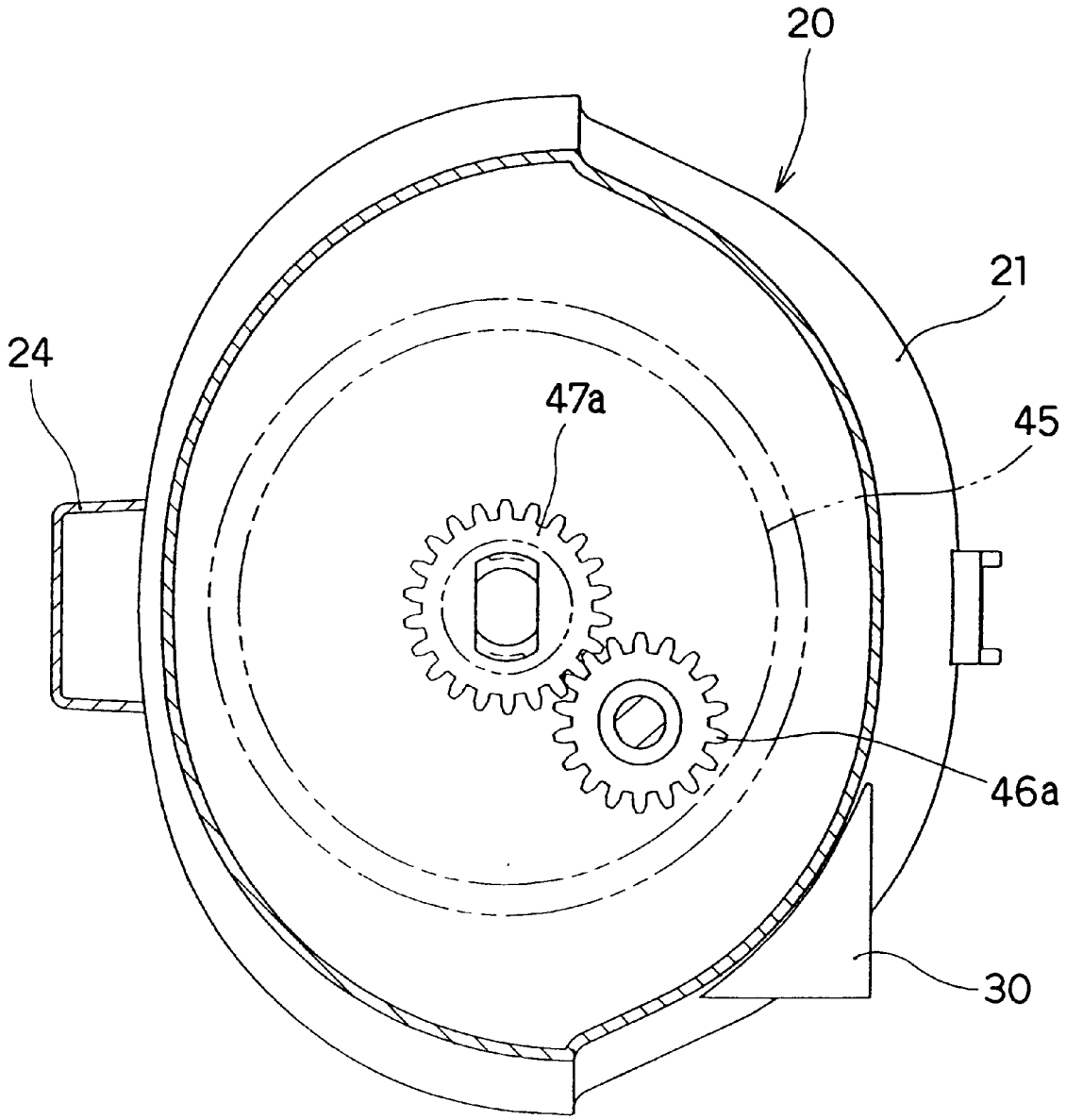
FIG. 32 is a view showing a lower step arrangement of a gear mechanism shown in FIG. 31.

The spur gear 46*a* is screwed to the other end side (rear surface side of the top plate 43 of the dust-collecting case) of the rotating shaft of the spur gear 46*b* as shown in FIG. 31(*b*), and as shown in FIG. 32, a gear 47*a* engaging with the spur gear 46*a* is formed on an outer periphery of a cylindrical portion of an attaching plate 45 of a pre-filter 22.

Therefore, by sliding the knob 66*a* for operating the slide lever which is provided on the side of the grip 24 of the dust-collecting device 20 in a direction of a blanked-out arrow of FIG. 31(*a*), the pre-filter 22 is rotated in a specified direction by means of the internal gear 66*c* formed on the slide lever 66, the moving gear 68*a*, the spur gear 46*b*, 46*a* which are uniformly formed in a vertical manner, and the gear 47.

Figure 33:
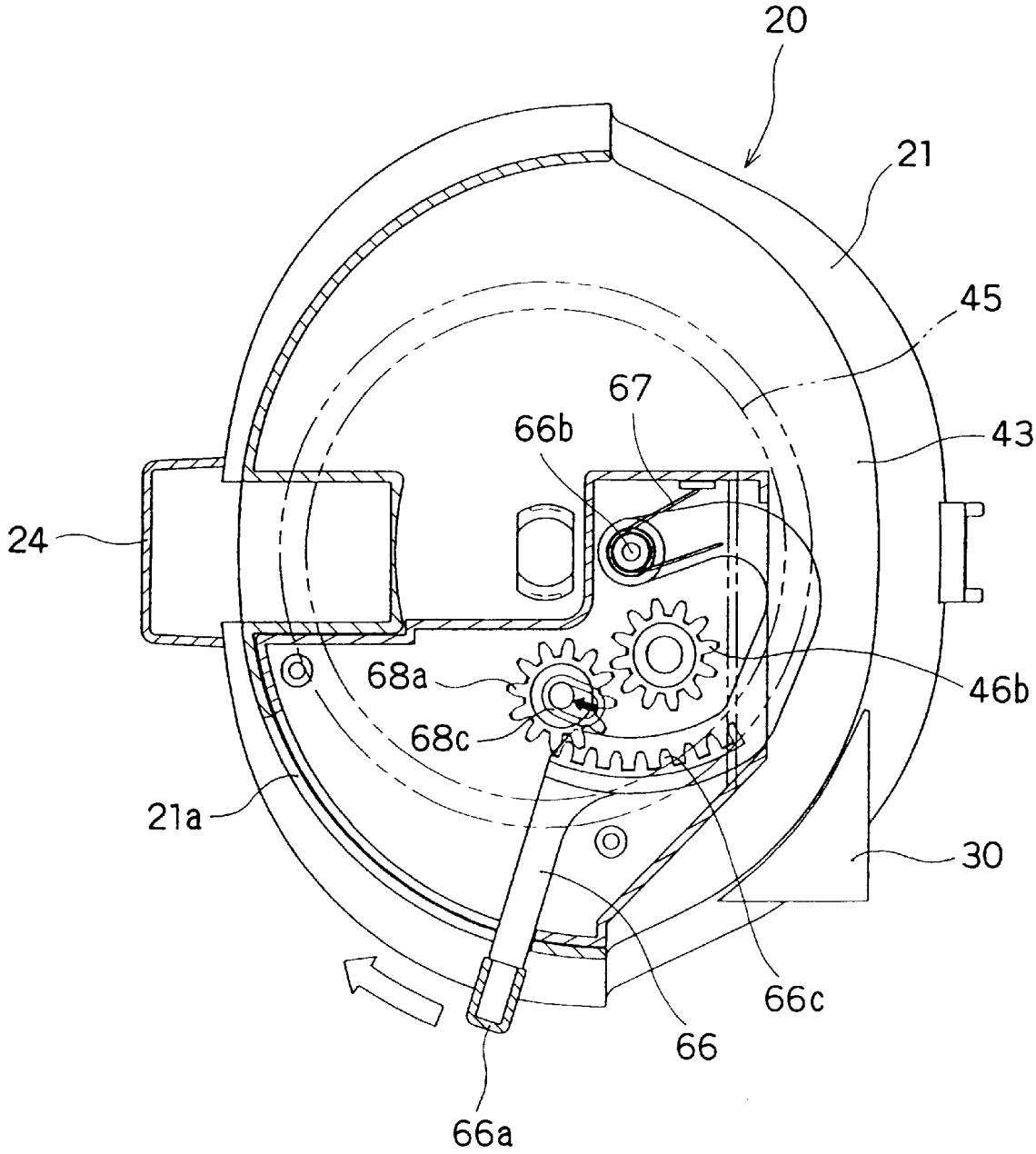
FIG. 33 is a view showing actions at a time the slide lever is returned in the still another embodiment of the present invention.

When removing one's hand from the operating knob 66*a* which has been slid, the slide lever 66 moves in the direction of the blanked-out arrow by the energizing force of the torsion spring 67 as shown in FIG. 33 to return to the original position. At this time, the spur gear 68*a* provided to be movable within a specified scope is pressed by the internal gear 66*c* which is formed on the slide lever 66 to move in the direction of the arrow to be disengaged with the spur gear 46*b*, so that the gear 46*b*, 46*a*, 47*a* are not rotated, and thus the pre-filter 22 is not rotated, either. That is, by sliding the operating knob 66*a*, the pre-filter 22 can be constantly rotated in a specified direction.

When the pre-filter 22 is rotated, protrusions 50 formed inside thereof repel a pleat-like tip end portion (resin 54) of the main filter 23 so that minute dust adhering on the surface of the main filter 23 is shaken down through this oscillation to drop downward like in the above embodiments. Since the pre-filter 22 is simultaneously oscillated through reaction, minute dust adhering to the pre-filter 22 can also be removed. Moreover, large-sized dust (coarse dust) deposited within the dust-collecting case 21 in a compressed condition functions to wipe off minute dust adhering on the outer peripheral surface of the pre-filter 22, the dust removing effects can be further improved. Therefore, degradations in dust-collecting efficiency owing to adhesion of dust to the main filter 23 (and the pre-filter 22) can be effectively prevented.

Further, while large-sized dust (coarse dust) deposited within the dust-collecting case 21 gradually blocks a mesh 51 formed in the lower portion of the pre-filter 22, a spiral rib 52 formed on the outer periphery of the pre-filter is rotated owing to the above-described rotation of the pre-filter 22 so that dust such as flock-like dust which has been adhering to the pre-filter 22 is pushed and expanded in a direction of the outer periphery thereof to thereby secure a flow passage for air, so that decreases in amount of air owing to plugging can be restored. It is possible to prevent degradation of dust-collecting efficiency also through this arrangement.

Next, for discharge of dust which has been accumulated in the dust-collecting case 21, by holding the grip 24 and pulling the device with pressing an operating button 28*a* of a clamp 28 disposed above the grip 24, the dust-collecting device 20 is detached from the main body 1 of the vacuum cleaner.

By pressing a button 33*a* of a lever 33 is provided in the lower portion of the dust-collecting case 21 on the opposite side of the grip 24, the clamp 34 is detached whereby the bottom lid 32 is opened to enable discharge of dust which has been accumulated in the dust-collecting case 21. At this time, especially flock-like dust adheres to the inner wall of the dust-collecting case 21 in a compressed state so that dust does not easily come off as it is. Thus, the slide lever 66 is operated for rotating the pre-filter 22 in a specified direction, the spiral rib 52 provided on the outer periphery of the pre-filter 22 acts to push out dust such as flock-like dust in a compressed state, so that easy discharge is enabled.

Thus, by employing the above-described slide lever 66, operations can be performed at the time of discharge of dust without being conscious of the rotating direction of the pre-filter 22 to thereby improve operatability.

Figure 34A:
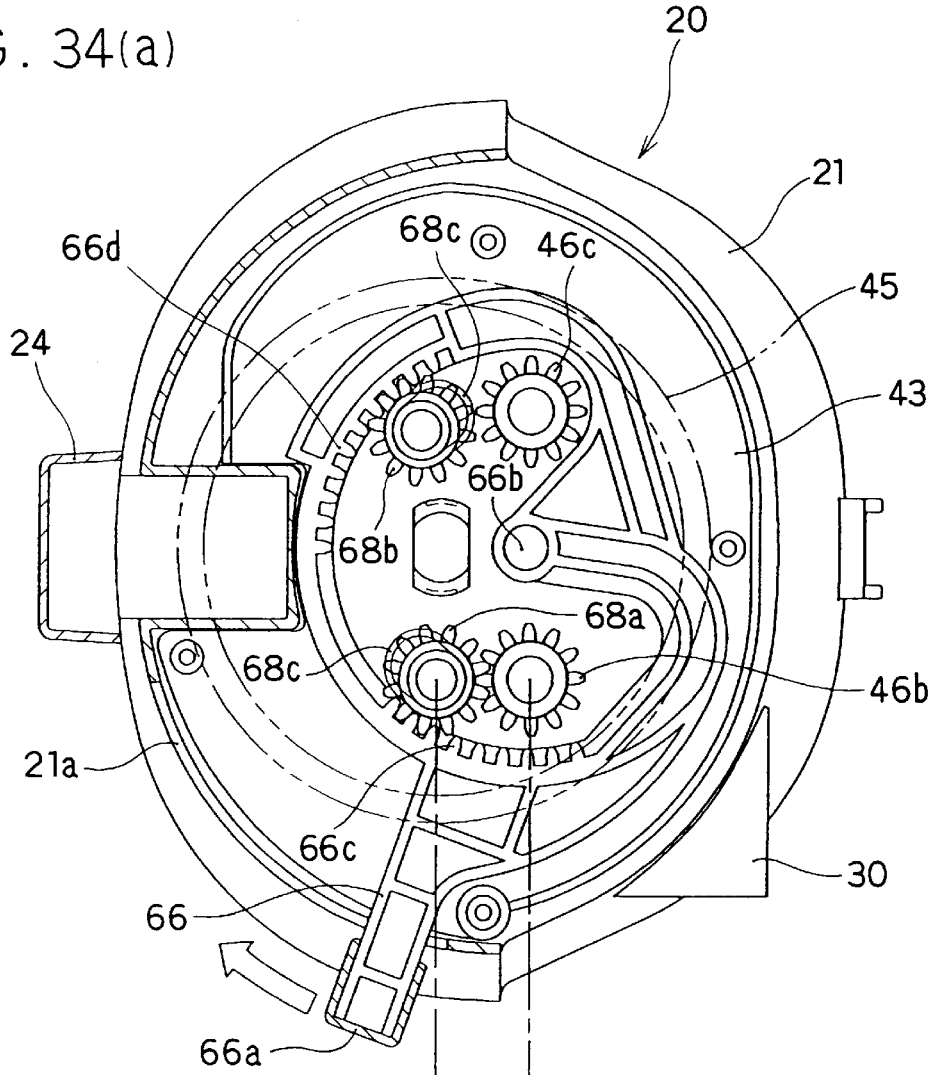
FIG. 34(*a*) and FIG. 34(*b*) are views showing a slide lever and a gear mechanism of a dust-collecting device according to another embodiment of the present invention wherein FIG. 34(*a*) is a view of an upper step arrangement of the gear mechanism and FIG. 34(*b*) a longitudinal sectional view of a main part thereof.
Figure 34B:
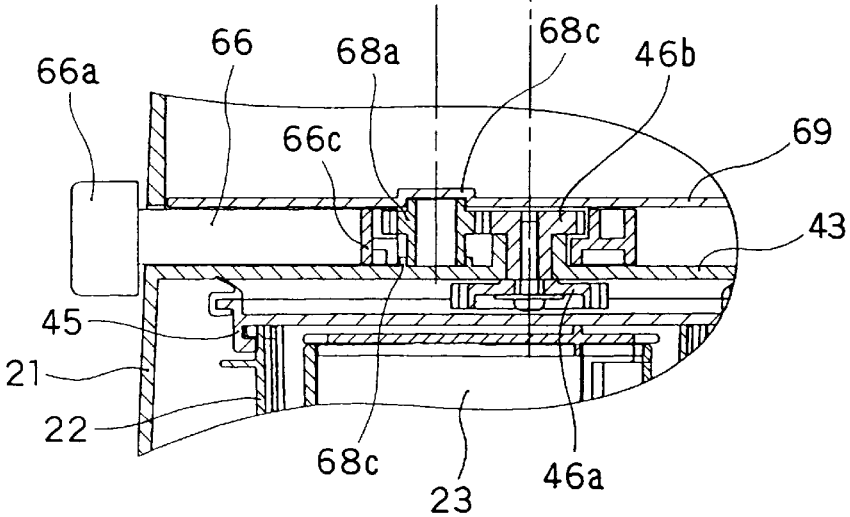

While the above embodiment is so arranged that the pre-filter 22 is rotated in a specified direction only when the slide lever 66 is slid in a single specified direction, by employing an arrangement as shown in FIGS. 34 and 15, it is also possible to make the pre-filter 22 rotate in the specified direction at any of the operations of the slide lever 66 either in the forward or backward direction.

Figure 35:
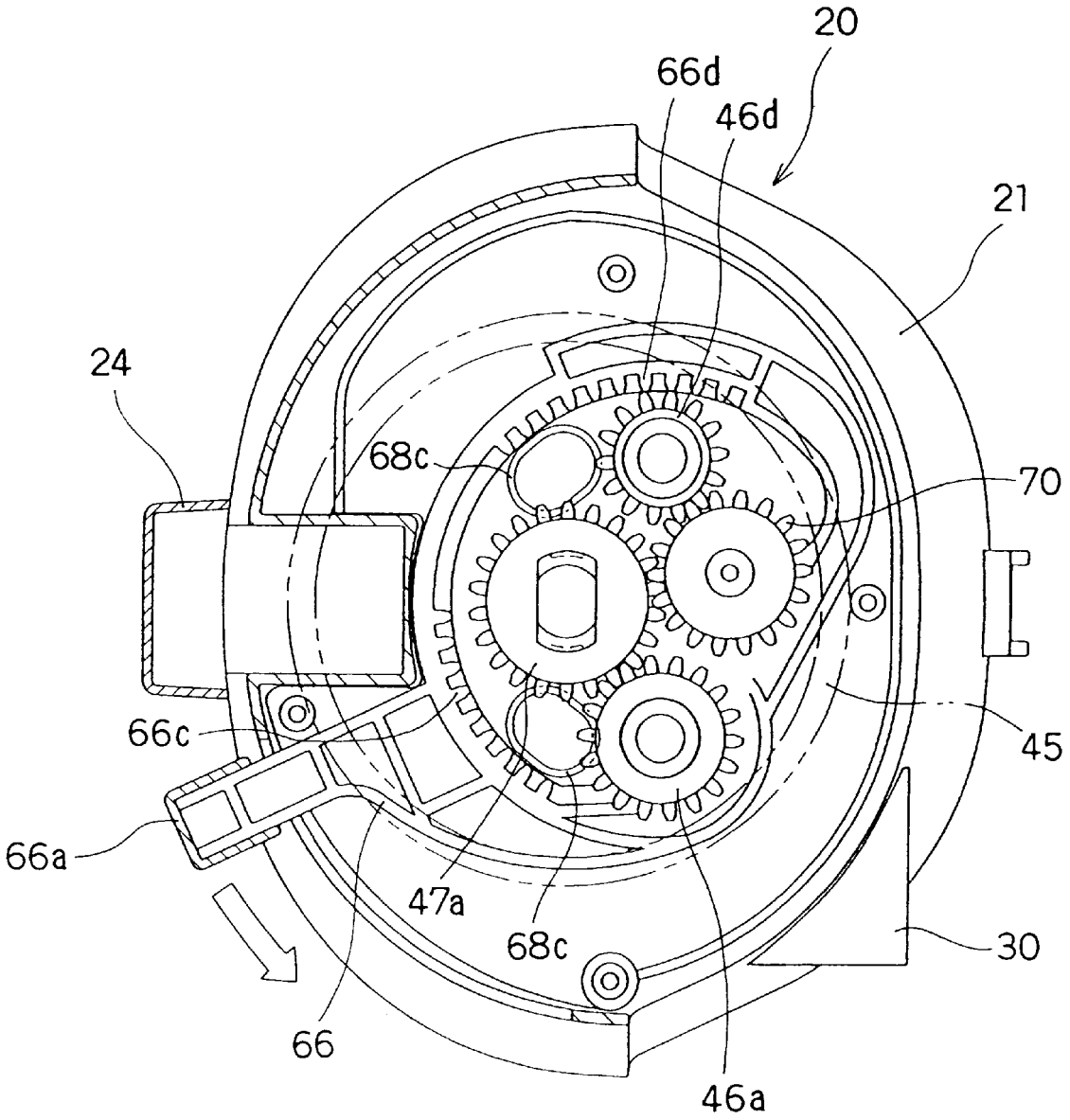
FIG. 35 is a view showing a lower step arrangement of the gear mechanism shown in FIG. 34.

That is, the slide lever 66 is provided with an internal gear 66*d,* moving gear 68*b,* spur gears 46*c,* 46*d* uniformly formed in a vertical direction which are similar to those of the previous embodiment on an opposite side of that of the previous embodiment (FIGS. 31 to 33) and an idle gear 70 is interposed between the spur gear 46*d* and the gear 47*a* as shown in FIG. 35 to set the rotating direction to be an identical direction as that of the previous embodiment.

With the above arrangement, the pre-filter 22 might be rotated in the same specified direction by operating the slide lever 66 in either the forward or backward direction to thereby shorten time required for the operation, and the operatability can be further improved.

It should be noted that while a filter rotating means of slide lever type of the above-described arrangement is provided in a device of which fulcrum 31 for opening and closing a bottom lid 32 of a dust-collecting device 20 is disposed on a side of a grip 24, similar functions and effects can be achieved by applying the same to a device wherein the fulcrum 31 for opening and closing the bottom lid 32 of the dust-collecting device 20 is disposed opposite to the grip 24 as represented in FIGS. 19 to 28.

As explained so far, the device of the present invention comprises a dust-collecting case which is fitted into a suction path extending from a suction nozzle to a motor blower in a freely attachable and detachable manner and from which accumulated dust can be discharged by opening a bottom lid of the dust-collecting case, and a cylindrical filter fitted into the dust-collecting case for filtering dust contained in air which is taken in into the dust-collecting case, wherein the filter is arranged to be rotatable, there is formed a spiral rib at an outer periphery of the filter, and the device is equipped with a rotating means for rotating the filter. With this arrangement, dust which cannot be discharge by its own weight since it is in a compressed state can be pushed out through the spiral rib formed on the outer periphery of the filter by rotating the filter, so that dust accumulated within the dust-collecting case in a compressed state can be easily discharged.

Further, the device of the present invention comprises a dust-collecting case which is fitted into a suction path extending from a suction nozzle to a motor fan in a freely attachable and detachable manner and from which accumulated dust can be discharged by opening a bottom lid of the dust-collecting case, a cylindrical pre-filter fitted into the dust-collecting case for filtering coarse dust contained in air which is taken in into the dust-collecting case, and a cylindrical main filter fitted into the pre-filter for filtering minute dust contained in air which has been filtered by the pre-filter for eliminating coarse dust, wherein the pre-filter is arranged to be rotatable, there is formed a spiral rib at an outer periphery of the pre-filter, and the device is equipped with a rotating means for rotating the pre-filter. With this arrangement, dust which cannot be discharge by its own weight since it is in a compressed state can be pushed out through the spiral rib that is formed on the outer periphery of the filter by rotating the filter, so that dust accumulated within the dust-collecting case in a compressed state can be easily discharged, similarly to the above case.

Since the pre-filter is so formed that its filter portion is designed to be located in a lower portion in the dust-collecting case, the compression rate of dust can be increased and a large amount of dust can be collected even though dust-collecting capacities remain the same.

Since the pre-filter is further provided with elastic protrusions which hit against the main filter through rotation thereof to make the main filter oscillate, minute dust which is adhering to the main filter can be easily removed, and since the pre-filter is oscillated owing to reaction caused by the elastic protrusions abutting against the main filter, dust which is adhering to the pre-filter can be also removed. While this can be performed on an intentional basis, the above dust-removing action owing to oscillation is affected each time the pre-filter is rotated for performing discharge of dust which has been accumulated in the dust-collecting case, so that the filter can be constantly maintained in a clean condition on an unconscious basis to prevent degradation in dust-collecting efficiency.

The provision of the main filter in a pleat-like shape and the provision of the elastic protrusions formed on the inner peripheral side of the pre-filter which abut against the pleat-like tip end portion of main filter make it possible that the surface side of the main filter to which minute dust adheres is repelled so that adhering dust can be more efficiently removed.

By covering the portion of the main filter at which the elastic protrusions of the pre-filter abut with resin, wear of the main filter owing to contact with the protrusions can be prevented.

By arranging a handle and a gear mechanism for connecting a rotating shaft of the handle and an attaching plate for the pre-filter as the rotating means, the pre-filter can be reliably rotated with a relatively simple arrangement.

By connecting the handle to its rotating shaft in a freely foldable manner and by forming the handle accumulating portion on the dust-collecting case for accumulating the handle when it is being folded, there can be prevented inconveniences that the handle is erroneously rotated when it is not necessary or that the handle is damaged by hitting against something.

By forming the grip at the dust-collecting case, by providing the handle on the upper portion of this grip, and by forming the handle accumulating portion on the grip, discharge of dust which has been accumulated within the dust-collecting case can be easily performed by holding the grip and the handle can be accumulated by effectively utilizing the grip which is not being used when performing cleaning.

On the other hand, while forming the grip on the lateral side of the dust-collecting case and the handle on the upper surface side of the dust-collecting case, the hand holding the grip and the hand rotating the handle can be prevented from interfering each other so that the handle might be easily rotated.

Alternatively, in case of providing a slide lever and a gear mechanism which is connected in case the slide lever is slid in either direction for rotating the pre-filter in a specified direction as the rotating means, operations can be performed without being conscious of the direction for rotating the pre-filter at the time of performing discharge of dust to thereby improve operatability.

By providing a gear mechanism for rotating the pre-filter in the specified direction by being connected at the time the slide lever is being slid in the opposite direction, the pre-filter can be rotated in the same specified direction regardless of the direction of the slide lever in either the forward or backward direction, and the time required for operation can be shortened to further improve the operatability.

By arranging the dust-collecting case with a grip wherein a fulcrum for opening and closing the bottom lid is provided on the same side as that of the grip, there can be prevented by the bottom lid that dust to be discharged moves toward the user holding the grip when the bottom lid is opened with holding the grip, thereby preventing inconveniences that dust falls on the user.

On the other hand, by arranging the dust-collecting case with a grip wherein a fulcrum for opening and closing the bottom lid is provided on an opposing side as that of the grip, fitting can be performed without touching the bottom lid soiled by dust at the time of performing discharge of dust, the device might be utilized without staining one's hand and thus in a hygienic manner.

Moreover, the present invention is applied to an upright type vacuum cleaner with the above-described dust-collecting device for a vacuum cleaner being fitted to a main body of the upright type vacuum cleaner in a freely attachable and detachable manner wherein the vacuum cleaner comprises a handle for operating the main body extending upward from a front surface side of the main body of the vacuum cleaner, the dust-collecting device is fitted to the front surface side of the main body of the vacuum cleaner in a freely attachable and detachable manner, and a grip of the dust-collecting device is formed to extend downward from the handle in a successive manner for operating the main body. With this arrangement, the gripping portion of the handle for operating the main body is located at a high position in case of performing cleaning, for instance an area located under a bed, by inclining the main body rearward, the user needs not to bend himself or herself down so that the user can perform cleaning at an easy posture, and since the handle for operating the main body as well as the grip of the dust-collecting device are aligned on the same line on the front surface of the main body, the device is designed to assume a neat and harmonized appearance.

What is claimed is:

1. A dust-collecting device for a vacuum cleaner comprising a dust-collecting case which is fitted into a suction path extending from a suction nozzle to a motor fan in a freely attachable and detachable manner and from which accumulated dust can be discharged by opening a bottom lid of the dust-collecting case, and a cylindrical filter fitted into the dust-collecting case for filtering dust contained in air which is taken in into the dust-collecting case, wherein the filter is arranged to be rotatable, a spiral rib is formed at an outer periphery of the filter, and the device is equipped with a rotating means for rotating the filter.

2. A dust-collecting device for a vacuum cleaner comprising a dust-collecting case which is fitted into a suction path extending from a suction nozzle to a motor fan in a freely attachable and detachable manner and from which accumulated dust can be discharged by opening a bottom lid of the dust-collecting case, a cylindrical pre-filter fitted into the dust-collecting case for filtering coarse dust contained in air which is taken in into the dust-collecting case, and a cylindrical main filter fitted into the pre-filter for filtering minute dust contained in air which has been filtered by the pre-filter for eliminating coarse dust, wherein the pre-filter is arranged to be rotatable, a spiral rib is formed at an outer periphery of the pre-filter, and the device is equipped with a rotating means for rotating the pre-filter.

3. The dust-collecting device of claim 2, wherein a filter portion of the pre-filter is designed to be located in a lower portion in the dust-collecting case.

4. The dust-collecting device of claim 2, wherein the pre-filter is provided with elastic protrusions which hit against the main filter through rotation thereof to make the main filter oscillate.

5. The dust-collecting device of claim 2, wherein the rotating means includes a handle and a gear mechanism for connecting a rotating axis of the handle and an attaching plate for the pre-filter.

6. The dust-collecting device of claim 2, wherein the rotating means includes a slide lever and a gear mechanism which is connected to the slide lever in case the slide lever is slid in either direction for rotating the pre-filter in a specified direction.

7. The dust-collecting device of claim 1, wherein the device is provided with a grip, and a fulcrum for opening and closing the bottom lid is provided on a same side as that of the grip.

8. The dust-collecting device of claim 1, wherein the device is provided with a grip, and a fulcrum for opening and closing the bottom lid is provided on an opposing side as that of the grip.

9. An upright type vacuum cleaner with a dust-collecting device for a vacuum cleaner being fitted to a main body of the upright type vacuum cleaner in a freely attachable and detachable manner, the dust-collecting device comprising a dust-collecting case which is fitted into a suction path extending from a suction nozzle to a motor fan in a freely attachable and detachable manner and from which accumulated dust can be discharged by opening a bottom lid of the dust-collecting case, and a cylindrical filter fitted into the dust-collecting case for filtering dust contained in air which is taken in into the dust-collecting case, in which the filter is arranged to be rotatable, a spiral rib is formed at an outer periphery of the filter, and the device is equipped with a rotating means for rotating the filter, wherein the vacuum cleaner comprises a handle for operating the main body extending upward from a front surface side of the main body of the vacuum cleaner, the dust-collecting device is fitted to the front surface side of the main body of the vacuum cleaner in a freely attachable and detachable manner, and a grip of the dust-collecting device is formed to extend downward from the handle for operating the main body in a successive manner.

* * * * *